US005756918A

United States Patent [19]

Funaki

[11] Patent Number: 5,756,918

[45] Date of Patent: May 26, 1998

[54] MUSICAL INFORMATION ANALYZING APPARATUS

[75] Inventor: Tomoyuki Funaki, Hamamatsu, Japan

[73] Assignee: Yamaha Corporation, Japan

[21] Appl. No.: 902,252

[22] Filed: Jul. 29, 1997

Related U.S. Application Data

[63] Continuation of Ser. No. 635,157, Apr. 23, 1996, abandoned.

[30] Foreign Application Priority Data

Apr. 24, 1995 [JP] Japan ..... 7-123105
May 2, 1995 [JP] Japan ..... 7-123693

[51] Int. Cl.[6] ..... A63H 5/00; G10H 1/26; G10H 5/00

[52] U.S. Cl. ..... 84/649; 84/653; 84/654

[58] Field of Search ..... 84/600, 609, 615, 84/616, 634, 649, 653, 654

[56] References Cited

U.S. PATENT DOCUMENTS 4,506,580 3/1985 Koike ..... 84/609
5,418,322 5/1995 Minamitaka ..... 84/609
5,424,486 6/1995 Aoki ..... 84/613
5,510,572 4/1996 Hayashi et al. ..... 84/609

*Primary Examiner*—William M. Shoop, Jr.
*Assistant Examiner*—Jeffrey W. Donels
*Attorney, Agent, or Firm*—Rossi & Associates

[57] ABSTRACT

An musical information analyzing apparatus operates in a data-processing manner and segments a melody of a given music into phrases so that each phrase should be recognized by the human ear as a note string to be demarcated in grasping musical sensation, detects a musical scale prevailing in the phrase and determines a key of the phrase. In the phrase segmentation process, a rest duration datum is added to the preceding note duration datum. An average note duration is computed, and notes having a long duration with respect to the average note duration is set to constitute the phrase end. Several adjustments are conducted to improve the segmentation. The scale is detected by computing a scale establishment rate based on the note use rate in the phrase. An adjustment is performed to smooth the musical flow. A key is determined by computing a major/minor degree of the notes. The scale detection and the key determination is performed viewing through plural phrases to provide areal recognition by eliminating phrase-to-phrase fluctuation.

17 Claims, 16 Drawing Sheets

Fig.8(A)
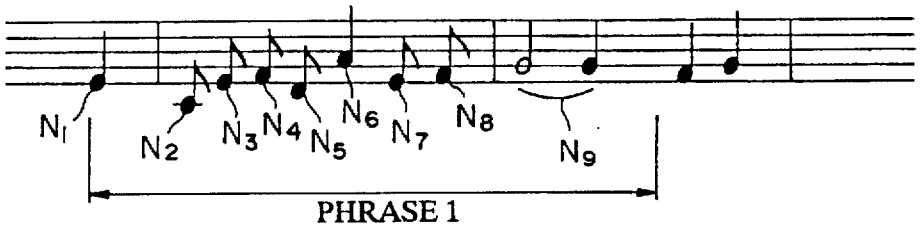
Fig.8(B)
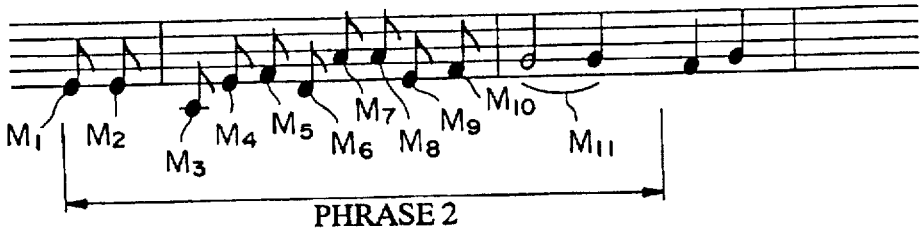
Fig.9(A)
| | N1 | | N2 | N3 | N4 | N5 | N6 | | N7 | N8 | N9 | | | | | |
|---|---|---|---|---|---|---|---|---|---|---|---|---|---|---|---|---|
| PITCH | 64 | 64 | 60 | 64 | 65 | 62 | 69 | 69 | 64 | 65 | 67 | 67 | 67 | 67 | 67 | 67 |
TIME →
Fig.9(B)
| | M1 | M2 | M3 | M4 | M5 | M6 | M7 | M8 | M9 | M10 | M11 | | | | | |
|---|---|---|---|---|---|---|---|---|---|---|---|---|---|---|---|---|
| PITCH | 64 | 64 | 60 | 64 | 65 | 62 | 69 | 69 | 64 | 65 | 67 | 67 | 67 | 67 | 67 | 67 |
TIME →

Fig. 10(A)
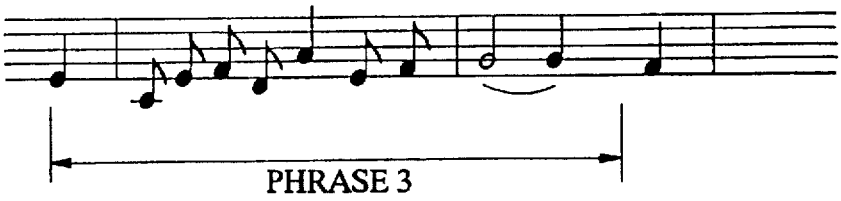
Fig. 10(B)
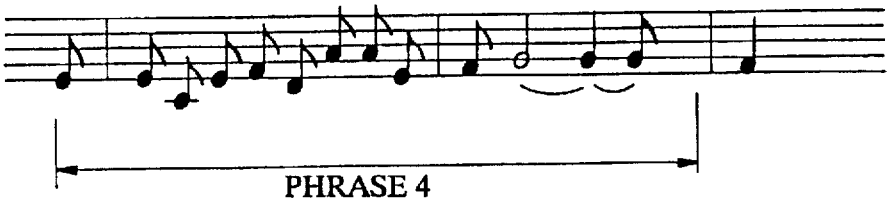
Fig. 11
PHRASE ↓ TIME →
| | | | | | | | | | | | | | | | | | |
|---|---|---|---|---|---|---|---|---|---|---|---|---|---|---|---|---|---|
| 3 | 64 | 64 | 60 | 64 | 65 | 62 | 69 | 69 | 64 | 65 | 67 | 67 | 67 | 67 | 67 | 67 | |
| 4 | | 64 | 64 | 60 | 64 | 65 | 62 | 69 | 69 | 64 | 65 | 67 | 67 | 67 | 67 | 67 | 67 | 67 |

Fig. 12(A)

PHRASE

TIME

| | | | | | | | | | | | | | | | | | |
|---|---|---|---|---|---|---|---|---|---|---|---|---|---|---|---|---|---|
| 3 | 64 | 64 | 60 | 64 | 65 | 62 | 69 | 69 | 64 | 65 | 67 | 67 | 67 | 67 | 67 | 67 | |
| 4 | 64 | 64 | 60 | 64 | 65 | 62 | 69 | 69 | 64 | 65 | 67 | 67 | 67 | 67 | 67 | 67 | 67 |

COMPARING SPAN

Fig. 12(B)

TIME

| | | | | | | | | | | | | | | | | | |
|---|---|---|---|---|---|---|---|---|---|---|---|---|---|---|---|---|---|
| 3 | | 64 | 64 | 60 | 64 | 65 | 62 | 69 | 69 | 64 | 65 | 67 | 67 | 67 | 67 | 67 | 67 |
| 4 | 64 | 64 | 60 | 64 | 65 | 62 | 69 | 69 | 64 | 65 | 67 | 67 | 67 | 67 | 67 | 67 | 67 |

COMPARING SPAN

Fig. 12(C)

TIME

| | | | | | | | | | | | | | | | | | |
|---|---|---|---|---|---|---|---|---|---|---|---|---|---|---|---|---|---|
| 3 | 64 | 64 | 60 | 64 | 65 | 62 | 69 | 69 | 64 | 65 | 67 | 67 | 67 | 67 | 67 | 67 | |
| 4 | | | 64 | 64 | 60 | 64 | 65 | 62 | 69 | 69 | 64 | 65 | 67 | 67 | 67 | 67 | 67 |

COMPARING SPAN

Fig. 12(D)

TIME

| | | | | | | | | | | | | | | | | | |
|---|---|---|---|---|---|---|---|---|---|---|---|---|---|---|---|---|---|
| 3 | 64 | 64 | 60 | 64 | 65 | 62 | 69 | 69 | 64 | 65 | 67 | 67 | 67 | 67 | 67 | 67 | |
| 4 | | | | 64 | 64 | 60 | 64 | 65 | 62 | 69 | 69 | 64 | 65 | 67 | 67 | 67 | 67 |

COMPARING SPAN

Fig. 12(E)

TIME

| | | | | | | | | | | | | | | | | | | |
|---|---|---|---|---|---|---|---|---|---|---|---|---|---|---|---|---|---|---|
| 3 | 64 | 64 | 60 | 64 | 65 | 62 | 69 | 69 | 64 | 65 | 67 | 67 | 67 | 67 | 67 | 67 | | |
| 4 | | 64 | 64 | 60 | 64 | 65 | 62 | 69 | 69 | 64 | 65 | 67 | 67 | 67 | 67 | 67 | 67 | 67 |

COMPARING SPAN

Fig. 13(A)
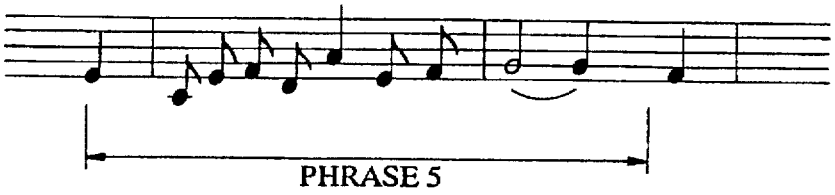
Fig. 13(B)
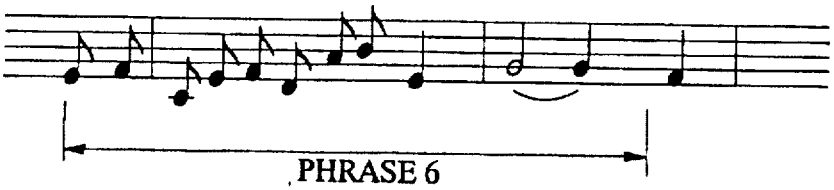
Fig. 14
| PHRASE | TIME | | | | | | | | | | | | | | | | |
|---|---|---|---|---|---|---|---|---|---|---|---|---|---|---|---|---|---|
| ADS | 0 | 1 | 2 | 3 | 4 | 5 | 6 | 7 | 8 | 9 | 10 | 11 | 12 | 13 | 14 | 15 | 16 |
| KON | 1 | 0 | 1 | 1 | 1 | 1 | 1 | 0 | 1 | 1 | 1 | 0 | 0 | 0 | 0 | 0 | |
| 5 | 64 | 64 | 60 | 64 | 65 | 62 | 69 | 69 | 64 | 65 | 67 | 67 | 67 | 67 | 67 | 67 | |
| 6 | 64 | 65 | 60 | 64 | 65 | 62 | 69 | 71 | 64 | 64 | 67 | 67 | 67 | 67 | 67 | 67 | 67 |
| KON | 1 | 1 | 1 | 1 | 1 | 1 | 1 | 1 | 1 | 0 | 1 | 0 | 0 | 0 | 0 | 0 | 0 |
Fig. 15
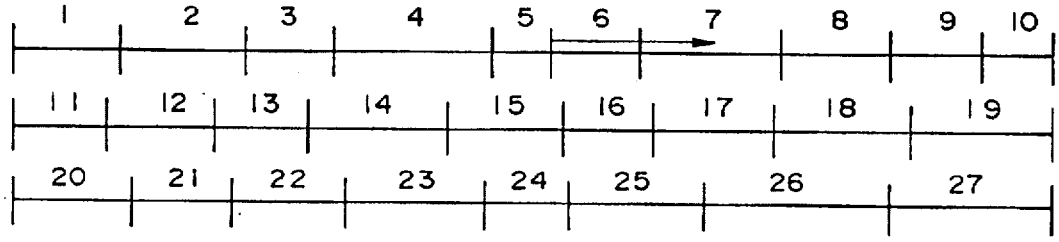

MUSICAL INFORMATION ANALYZING APPARATUS

This is a continuation of application Ser. No. 08/1635,157 filed Apr. 23, 1996, now abandoned.

BACKGROUND OF THE INVENTION

1. Field of the Invention

The present invention relates to a musical information analyzing apparatus which enables the phrase segmentation of a music and is suitable for analyzing the structure of the music, and more particularly to a musical information analyzing apparatus which is capable of setting boundaries between the phrases in a given musical tune based on the durations of the respective notes constituting the musical tune within a partial span or a whole span of the music, thereby providing proper musical phrase segmentation to meet the human sensation on phrasing according to the character of the music.

The present invention also relates to a musical information analyzing apparatus which enables such a scale recognition and a key detection of musical phrase segments comprised in a given musical tune as will meet the human musical sensation by particular processing of scale continuation, scale selection, major/minor degree computation and the like.

2. Description of the Prior Art

In the conventional technology of automatically dividing a given string of a melody into phrase segments, the following methods (a), (b) and (c) are known in the art.

(a) Detecting a plurality (e.g. four) of consecutive musical measures constituting a piece of melody which resembles a melody constituted by a same plurality (e.g. four) of certain other consecutive measures, and setting the start point of a phrase at the leading end of the detected consecutive measures.

(b) Detecting a time interval (a gate time) between the on-time (i.e. note start time) of a note and the on-time of the succeeding note which is not less than a predetermined time length (e.g. a whole note length), and setting the start point of a phrase at the top of the measure to which the succeeding note belongs.

(c) Adjusting the phrase segmentation on a note-by-note basis by first determining a measure having the start point of a phrase through a method of (a) or (b), and then analyzing a measure which precedes the thus determined measure. For example, in the case where the analyzed preceding measure contains plural notes, a phrase end is set at the trailing end of the longest note among those plural notes and a start point of the next phrase is set at the beginning of the note which comes next to that longest note, thereby recognizing a phrase of an up-beat start.

According to the methods (a) and (b) as mentioned above, the phrase segmentation is made on a measure-by-measure basis, and consequently is not capable of handling phrases which start in the middle way of a measure or sometimes sets a phrase demarcation amidst a string of melody which a human musical ear senses to be a phrase. With the methods (a), (b) and (c) combined together, it will be fairly possible to handle phrases which start amidst a measure but it will sometimes result in a situation where the phrase segmentation may not meet the character of the music or the human sensation on phrasing the music.

In the conventional technology, several attempts have been made to detect a scale prevailing in a given span of a music by computing the use frequencies (oftenness) of the respective notes per measure or other span to handle various types of music. Generally speaking, a music is sometimes composed in one scale only, sometimes in plural scales connected in sequence (modulation or transposition in key) and sometimes in a vague or indefinite scale which is a mixture of plural scales.

The conventional methods, however, have too many drawbacks to realize such a detection of the scales in a music as will coincide with the scale that a human being actually recognizes. The method with computation of the use frequencies of the notes within a short span of the music such as a measure or the like detects so many scales possibly established for the span that the determination of the best scale may be difficult. However, if the computation is executed with respect to a longer span, then the detection of the scale changing point may become hard to tell where.

Further in conventional methods, some countermeasures may be necessary so as not to be influenced by temporary modulation in a melody to cope with such a melody as will give a partially different scale momentarily. Still further, the method relying only on the use frequencies of the notes may sometimes determine plural scales at an equal preference level, which should need some additional countermeasures. Anyway, an automatic scale detection technology utilizing a computer will still encounter several problems to solve, such as how to determine a span for computation, how to grasp the progression of scales (properly judging partial modulation or indefinable key), and how to process the scales which may conflict with each other. Minor scale may be more difficult to determine, as there are different minor scales in nature. With respect to a harmonic minor scale and a melodic minor scale, the detected scale constituent notes indicate a minor mode and can uniquely determine a minor scale. With respect to a natural minor scale, however, the detected scale constituent notes can indicate both a minor scale and a relative major scale, and consequently can not uniquely determine which scale but need additional judgment on whether the phrase is in a major mode or in a minor mode there.

SUMMARY OF THE INVENTION

An object of the present invention is to provide a novel musical information analyzing apparatus capable of segmenting a music into phrases so that such a segmentation will match with the character of the music and also with the human sensation of phrasing the music.

Another object of the present invention is to provide a novel musical information analyzing apparatus capable of detecting from among segmented plural phrases those phrases each having a melody which resembles each other.

Still further object of the present invention is to provide a novel musical information analyzing apparatus capable of detecting a prevailing scale or a prevailing key in a given phrase of a music so that such a detection will match with the human sensation on scale and key.

In a first aspect of the present invention, a musical information analyzing apparatus comprises: receiving means for receiving music information representing a given music composed of musical notes and musical rests, the music information including pitch information and duration information of the notes and duration information of the rests constituting the given music; computing means for computing an average note duration for a predetermined span of the given music based on the note duration information in the span under processing; and phrase segmentation means for dividing the span of the given music into phrases by setting demarcating ends for each phrase based on the average note duration computed by the computing means.

In a second aspect of the present invention, a musical information analyzing apparatus comprises: computing means for computing a degree of resemblance between melodies of plural phrases of a given music which has been divided into phrases, detecting means for detecting, from among the plural phrases of the music, a phrase of which the degree of melody resemblance is above a predetermined reference resemblance level base on the degrees of resemblance computed by the computing means.

In a third aspect of the present invention, a musical information analyzing apparatus comprises: computing means for computing a scale establishment rate of each of plural phrases of a given music which has been divided into phrases, the computation being done based on pitch information of the music; scale extracting means for extracting from and for each of the phrase a musical scale which meet predetermined requirements for extracting a scale based on the scale establishment rate computed by the computing means; scale continuing means for continuing a scale for plural phrases by searching a phrase through such phrases as have no extracted scale therefrom by the scale extracting means but are sandwiched between the phrases which have a same extracted scale in common, and then by assigning the same extracted scale to the searched scale.

In a fourth aspect of the present invention, a musical information analyzing apparatus comprises: receiving means for receiving music information representing a given music and being divided into plural phrases; computing means for computing a scale establishment rate of each of the plural phrases based on the pitch information of the notes; first scale extracting means for extracting from and for each of the phrase a musical scale which meet predetermined requirements for extracting a scale based on the scale establishment rate computed by the computing means; second scale extracting means for extracting from among the musical scales extracted by the first scale extracting means plural scales which contiguously encompass from beginning to end of the given music; judging means for judging whether there is any phrase from which multiple scales have been extracted by the second extracting means; and scale selecting means for selecting, in case the result of the judgment by the judging means is affirmative, a scale which meets a predetermined requirements for selecting a scale to be determined as a scale for said phrase under judgment.

In a fifth aspect of the present invention, a musical information analyzing apparatus comprises: receiving means for receiving music information representing a span of music including plural phrases which have a detected scale thereof in common; computing means for computing a major/minor degree of the scale by comparing timewisely adjacent note pitches in each of the plural phrases; and determining means for determining a key of the span of music based on the major/minor degree computed by said computing means and on said detected scale.

According to the invention as mentioned in the first aspect above, the phrase demarcation points are set based on the average note duration (a mean value of the durations of the notes in the phrase). Therefore, the apparatus is capable of segmenting a given music into phrases reflecting the character and nature of the music, thus realizing a phrase segmentation which will be well accepted by the human sensation.

According to the invention as mentioned in the second aspect above, the phrases having a melody which resembles each other with a high degree of resemblance will be detected from among a plurality of phrases. Therefore, the apparatus is capable of distinguishing the phrases having melodies with high degree of resemblance from the rest of the phrases, and thereby conducting structural analysis of a music efficiently.

According to the invention as mentioned in the third aspect above, a phrase (or phrases) for which a scale has not been determined but which satisfies the requirements for scale continuation and which is sandwiched between the phrases whose scale has been determined as a scale identical to each other is searched and is unified to have the same scale as the sandwiching (preceding and succeeding) phrases. Therefore the apparatus is capable of handling phrases with an indefinable scale to make a clear scale progression even though the scale progression is interrupted at one or more phrases in the middle way of the music.

According to the invention as mentioned in the fourth aspect above, a plurality of scales which encompass contiguously from the beginning to the end of a music and then a judgment is made whether there is a phrase for which multiple scales have been determined. And when this judgment is affirmative, a single scale satisfying predetermined scale selection requirements is selected from among those multiple scales and is assigned to the phrase under judgment. Thus plural scales are aligned in smooth sequence from the beginning to the end of a music avoiding the multipleness and the apparatus is now available for a music which includes partial modulations.

For the apparatus in the above third or fourth aspect, a further provision of phrase segmentation means is preferable for dividing a whole or a partial span of a given music into phrases based on an average note duration within the span. This will enable a phrase segmentation matching human sensation, which in turn will a enable scale determination much closer to human sensation.

According to the invention as mentioned in the fifth aspect above, a major/minor degree of the scale is computed by comparing timewisely adjacent note pitches in each of the plural phrases and then a key of the span is determined based on the computed major/minor degree and on the detected scale. Therefore, the apparatus is capable of realizing a key detection for a natural minor scale in a manner similar to human sensation.

For the apparatus in the above fifth aspect, the computing means is preferably be of a type which computes the major/minor degree by comparing a pitch of an object note with pitches of preceding plural notes individually thereby obtaining individual major/minor points respectively and adding up the major/minor points with each point being weighted by a weighting factor which is so predetermined as to be greater as the distance between the object note and the preceding individual note with which the object note is compared is greater, the added-up points becoming a major/minor point of the object note, and in turn adding up major/minor points of the object notes in a musical phrase to obtain a major/minor point of the musical phrase under processing. This will enable a major/minor degree computation with more significance weighted on the major/minor degree of a note timewisely closer to the object note, which in turn will enable a scale determination much closer to human sensation.

BRIEF DESCRIPTION OF THE DRAWINGS

Other objects, features and advantages of the present invention will be more readily appreciated from the following detailed description of preferred embodiments thereof when taken in conjunction with the accompanying drawings, in which:

FIGS. 8(A) and 8(B) are musical stave notations illustrating phrases to be compared with each other by the use of a melody comparing method I;

FIGS. 9(A) and 9(B) are phase formats representing the phrases of FIGS. 8(A) and 8(B), respectively;

FIGS. 10(A) and 10(B) are musical stave notations illustrating phrases to be compared with each other by the use of a melody comparing method II;

FIG. 11 is a phase format representing the phrases of FIGS. 10(A) and 10(B);

FIGS. 12(A), 12(B), 12(C), 12(D) and 12(E) are phase formats representing the phrases of FIGS. 10(A) and 10(B) and showing the manner of comparing pitches between the two phrases;

FIGS. 13(A) and 13(B) are musical stave notations illustrating phrases to be compared with each other by the use of a melody comparing method III;

FIG. 14 is a phase format representing the phrases of FIGS. 13(A) and 13(B);

FIG. 15 is a phrase segmentation chart of a piece of music;

DESCRIPTION OF THE PREFERRED EMBODIMENT

Figure 1:
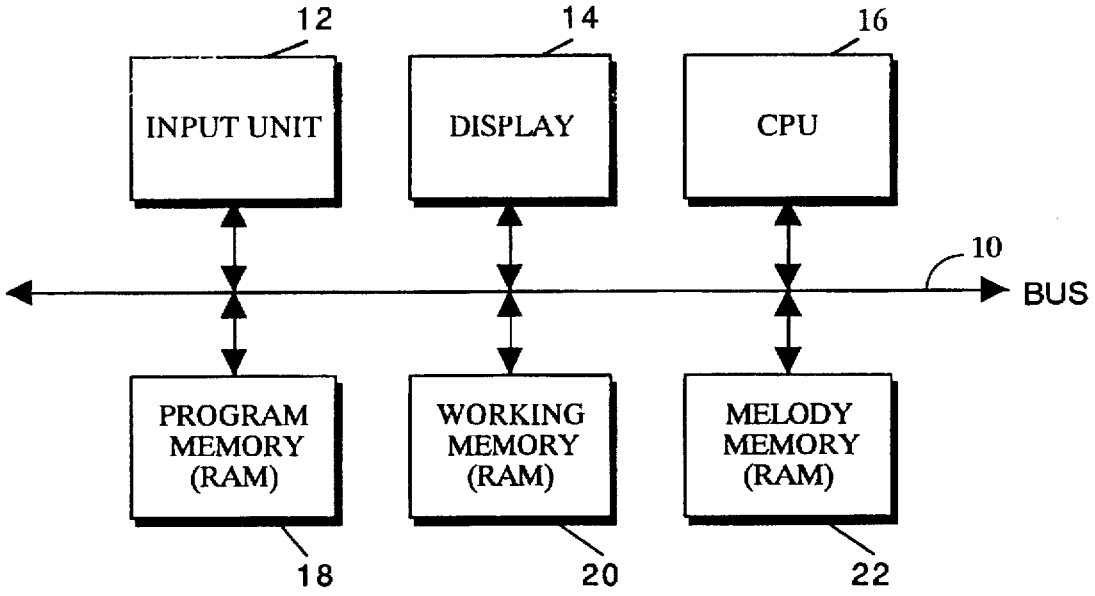
FIG. 1 is a schematic illustration of a block diagram of a musical information analyzing apparatus in accordance with the present invention.

As shown in FIG. 1, an embodiment of a musical information analyzing apparatus according to the present invention is constructed as a microcomputer-processed architecture wherein the signal processing of musical information is executed under the control of a microcomputer. The structure comprises an input unit 12, a display device 14, a central processing unit (CPU) 16, a program memory 18, a working memory 20 and a melody memory 22, all connected to a bus line 10 for associated and controlled operation.

The input unit 12 is of a type which includes a keyboard and other various inputting switches. As an operator of the apparatus operates the keyboard of the input unit 12, musical information (information on the pitches and durations of the notes and on the durations of the rests with respect to time) representing a melody of a given desired music is written into the memory 22. Other musical instruments and the like may also be a source of the musical information to be written into the memory via the input unit.

The display device 14 is to display a musical score and the like based on the musical information stored (written) in the memory 22. The CPU 16 executes various processing operations such as musical information loading, phrase segmentation, phrase grouping and musical stave notation display according to a program stored in the memory 18 consisting of a ROM. These processing operations will be explained with reference to FIGS. 2 through 15 hereinafter. The working memory 20 consists of a RAM and includes memory areas to be used as registers during the various processing operations of the CPU 16. Included among the registers are phrase number registers N and M, a group number register SN and so on as specific registered actually used in the processing with this invention. The registers N and M are set with the one and the other of the two phrase numbers under comparison. The melody memory 22 consists of a RAM and stores the musical information inputted through the input unit 12. Also stored in the melody memory are phrase demarcation information provided in association with the musical information, and group ID number information.

Figure 2:
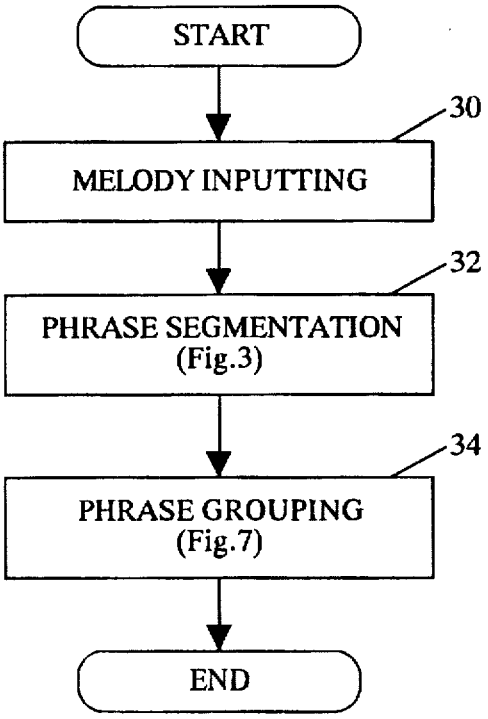
FIG. 2 is a flow chart of a main routine of one embodiment of the apparatus.

FIG. 2 shows a processing flow of a main routine in the embodiment of the present invention. A step 30 processes a melody inputting operation wherein the musical information including the melody information of a given music is inputted and is written in the memory 22. The display 14 in turn displays the melody information stored in the memory 22 for example in the form as shown in FIG. 4(A). A step 32 is to conduct a process of phrase segmentation. This process will be described in detail afterward with reference to FIG. 3. Then the routine proceeds to a step 34. In the step 34, a phrase grouping process takes place. This process will be described in detail later, referring to FIG. 7.

Figure 3:
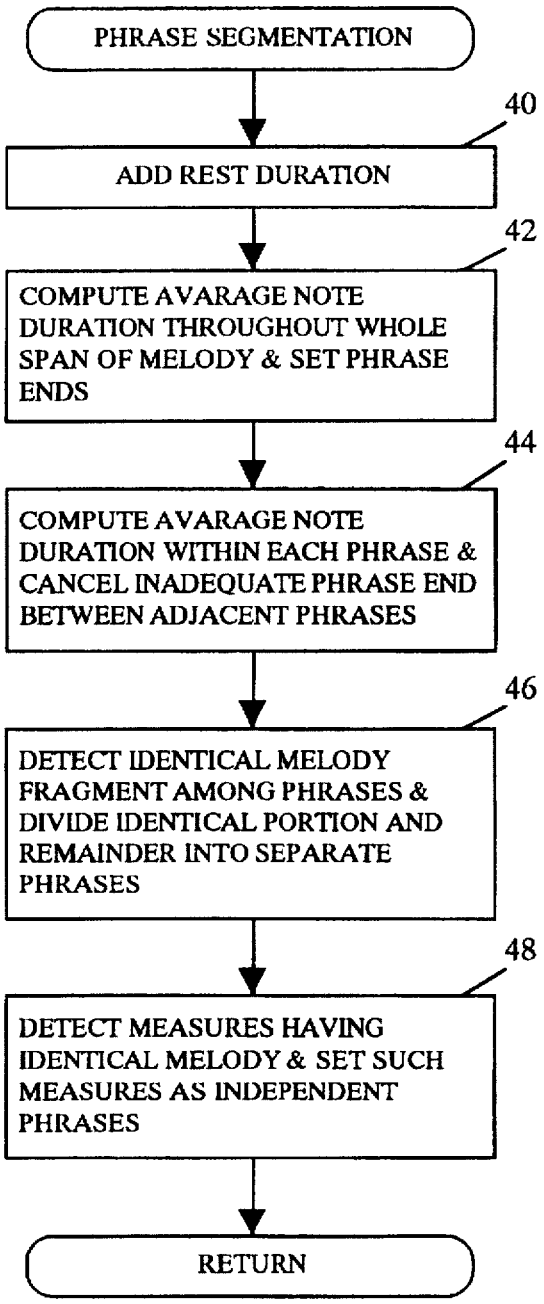
FIG. 3 is a flow chart of a subroutine for a phrase segmentation processing.
Figures 4A, 4B, 4C:
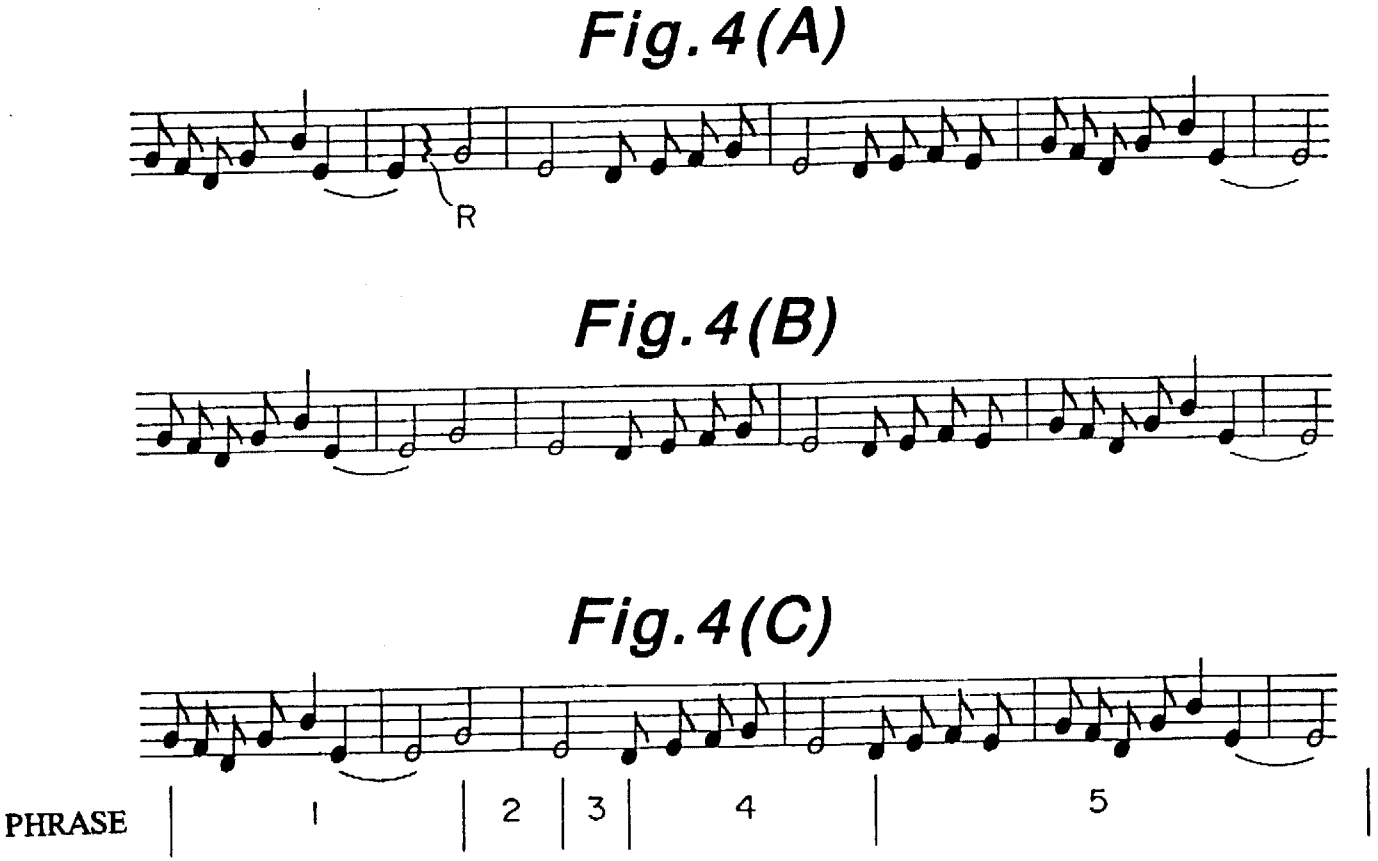
FIGS. 4(A), 4(B) and 4(C) are musical stave notations illustrating how the process goes through steps 40 and 42 in FIG. 3.

FIG. 3 shows a subroutine of the phrase segmentation precessing. This processing of FIG. 3 is performed over the melody information shown as an example in FIG. 4(A) and stored in the memory 22.

First in a step 40, a processing is conducted for adding the duration (time length) of a rest to the duration of a note. This processing is to search for a rest which is positioned next to a note one by one, and every time such a rest is found, the duration information of the rest is added to the duration information of the preceding note. This process is introduced herein in light of the natural feeling that a listener of the music tends to keep an after-sensation of the preceding note during the time period of a rest, in the case a rest comes after a sounding note. With this adjustment, the melody information is now constituted by only two kinds of information, i.e. note pitch information and note duration information without deteriorating the music progressing rhythm for processing.

As an example, when the search of the step 40 locates the existence of a quarter (crotchet) rest R as shown in FIG. 4(A), the duration of this quarter rest is added to the duration of the preceding quarter (crotchet) note to make a half (minim) note as shown in FIG. 4(B). Thus after the process of adding the rest durations to the preceding note durations, the display 14 displays the melody information as shown in FIG. 4(B). Then the routine proceeds to a step 42.

A step 42 computes an average note duration (a mean value of the note duration values) based on the thus adjusted note duration information over the whole span of the melody. For the sake of simplicity, an example is explained to compute the average note duration for the span shown in FIG. 4(B) instead of the whole span of the given music, and is shown in Table 1 below. The note durations are expressed in terms of "points" where one point represents the duration (time length) of a thirty-second note.

TABLE 1

| Note | Points (P) | Number (Q) | Total Points (PQ) |
|---|---|---|---|
| Eighth | 4 | 16 | 64 |
| Quarter | 8 | 2 | 16 |
| Half | 16 | 3 | 48 |
| Half + Quarter | 24 | 2 | 48 |
| Sum Total | | 23 | 176 |
| Average Note Duration = 176/23 = 7.65 | | | |

Next, the obtained average note duration (herein set as "a") is multiplied by a predetermined factor "b" to make a product "a×b", and then a border note duration is determined to be equal to or close to this product value "a×b", and thereafter a search is conducted for notes each having this border note duration, the end of each thus found note is set to be a phrase end, and each of the phrases is given a phrase ID number. In the example shown in FIG. 4(B), the average note duration "a"=7.65 is multiplied by a factor "b"=2 to produce "a×b"=15.3, which in turn determines the border note duration to be a half note (P=16). Consequently, as shown in FIG. 4(C), phrase ends are set at the end of respective half notes, and phrase ID numbers are given to the respective phrases. And finally the display 14 displays on its screen the melody information as segmented into phrases and identified by the phrase ID numbers as shown in FIG. 4(C). Then the process move forward to a step 44.

In step 44, an adjustment processing is applied to the phrase segmentation to cope with the "slow move area" in the melody. Although the step 42 enables the phrase segmentation which is proper for the music and will meet the natural feeling of a human being, the use of an average note duration over the whole melody span may not adequately demarcate all phrases among those including a "quick move area" and those including a "slow move area" as compared with, the human phrasing sensation. However, if a melody is divided into plural spans without any particular intention and an average note duration is computed for each span, the average note durations may vary from one phrase to another according to the dividing manner and the different phrasing may be applied to the same melody fragments existing at plural areas in the melody. In this connection, it is preferable to determine a single average note duration value for one whole melody. In the embodiment under explanation, the phrase segmentation by the step 42 is directed to fairly "quick move areas" here, leaving the phrase segmentation for "slow move areas" to the step 44.

In the step 44, an average note duration is computed for each phrase based on the note duration information within the phrase. The manner of the computation of the average note duration is similar to the manner shown in Table 1. With respect to each adjacent two phrases, as sequentially picked up, the following judgment in Equation 1 is conducted for each phrase and cancels the demarcation between the two in case the judgment result is negative.

average note duration within the phrase ×2

<end note duration of the phrase Equation 1

Table 2 shows the average note durations and the end note durations of the respective phrases 1 through 5 shown in FIG. 4(C)

TABLE 2

| Phrase No. | Average note duration | End note duration |
|---|---|---|
| 1 | 8 | 24 |
| 2 | 16 | 16 |
| 3 | 16 | 16 |
| 4 | 6.4 | 16 |
| 5 | 6.4 | 24 |

In the above Table 2, both the average note durations and the end note durations are expressed in point values as in Table 1

The end note duration of phrase 1 is 24 in terms of point, while the average note durations of phrase 1 and phrase 2 are 8 and 16, respectively. The average note duration multiplied by the constant (which is 2 here) is 16 for phrase 1, and 32 for phrase 2. The end note duration "24" of phrase 1 is greater than two times the average note duration (2×8=16) and this meet the condition of Equation 1. Consequently, the demarcation remains there as has been determined. Next with respect to phrase 2, the end note duration is 16, while the average note durations of phrase 2 and phrase 3 are both 16. Two times the average note duration is 32 for both phrase 2 and phrase 3. As the end note duration of phrase 2 is "16" and is smaller than the average note duration "32" of both phrase 2 and phrase 3, and therefore does not satisfy Equation 1. Accordingly, the demarcation between phrase 2 and phrase 3 is now cancelled to make a result shown in FIG. 5(A).

Thereafter, a similar procedure as has been described above with respect to phrases 1 through 3 will take place until the end of the melody. As a result, phrase segmentation will be adjusted to properly match the existing "slow move areas" all over the music. Then the musical stave notation including the thus adjusted phrase segmentation is displayed on the display 14, and the process moves to the next step 46.

The step 46 conducts a processing of phrasing adjustment for further improving the segmentation to more closely resemble the human phrase recognition. Namely, whereas a human being can recognize the same melody fragments as a phrase while hearing a melody, the program as described up to step 44 is not capable of segmenting the same melody fragments into phrases. For example, in case a same melody fragment exists at two locations in a melody string and the one melody fragment is preceded by a long note while the other melody fragment is preceded by a not-so-long note, the program may recognize the former as a phrase but not the latter. The latter may be regarded as a continuing part of the preceding phrase. On the contrary, a human being has an ability to feel and recognize each of the same melody fragments as each individual phrase. Accordingly, this embodiment is so designed as to perform the phrase segmentation by detecting the same melody fragments through steps 46 and 48.

The step 46 detects the existence of the phrases including the same melody fragment as any other phrase, judges whether the remaining portion other than the melody fragment within the detected phrase is not shorter than the predetermined minimum duration (e.g. two beats, i.e. a half note length) to be a phrase, and divide the melody fragment and the remaining portion from each other to make individual phrases when the judgment results affirmative. When the judgment turns out to be negative, the phrase is determined to be with an up-beat start and will not be further divided. In order to judge the identicalness of the melodies among plural phrases, a pattern matching method can be used wherein coincidence of note pitches are detected one after another with respect to every unit length (e.g. a eighth note duration) along the time axis. The pattern matching method will be described later with reference to FIGS. 8(A), 8(B), 9(A) and 9(B).

Figure 5A:
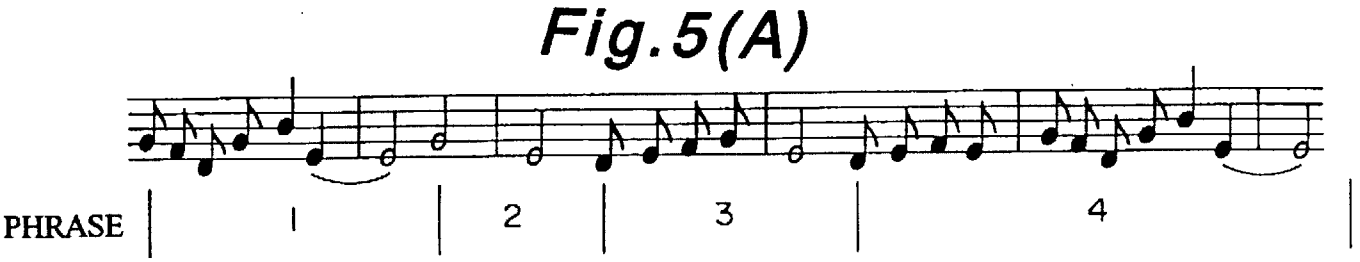
FIGS. 5(A) and 5(B) are musical stave notations illustrating how the process goes through steps 44 and 46 in FIG. 3.
Figure 5B:
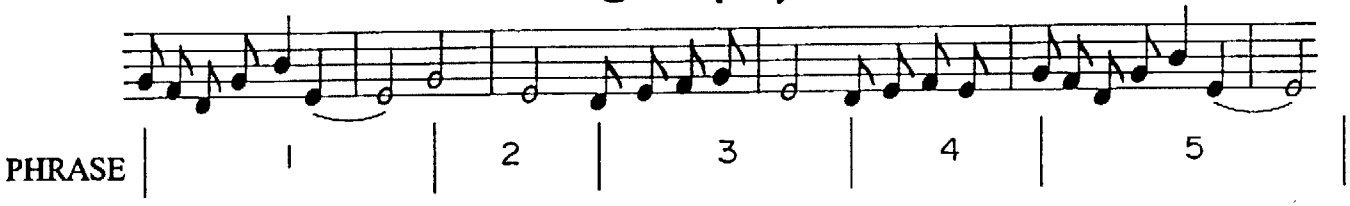

As an example, the melody of FIG. 5(A) includes a phrase #4 which contains a melody segment as same as the phrase #1. After detecting the phrase #4, the step 46 judges whether the remaining portion other than the melody fragment of the same melody is equal to or greater than two beat duration, to produce an affirmative judgment. Accordingly, the portion with the same melody fragment and the remaining portion are divided into separate phrases #4 and #5 as depicted in FIG. 5(B). The thus adjusted musical stave notation is displayed on the display device 14, and the process proceeds to step 48.

Figure 6A:
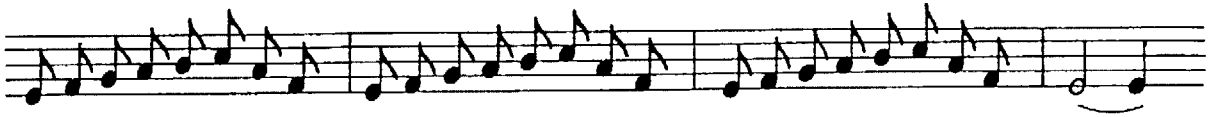
FIGS. 6(A) and 6(B) are musical stave notations illustrating how the process goes through a step 48 in FIG. 3.
Figure 6B:
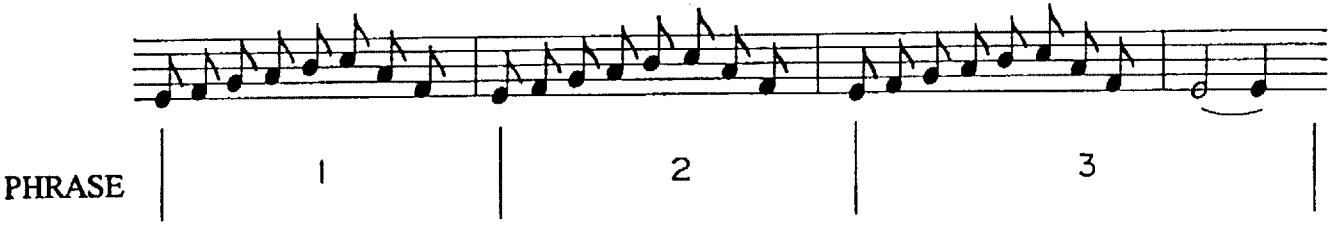

The step 48 is for a further adjustment and detects within each phrase the existence of measures whose melodies are same with each other and divide the measures having that same melody are individually divided into separate phrases. For example, in the phrase shown in FIG. 6(A), measures #1, #2 and #3 are judged to have a same melody fragment through a pattern matching method, and the respective measures are segmented into respective phrases as shown in FIG. 6(B). Thus adjusted result is displayed in a musical stave notation on the display 14, and then the program returns back to the main routine of FIG. 2.

Figure 7:
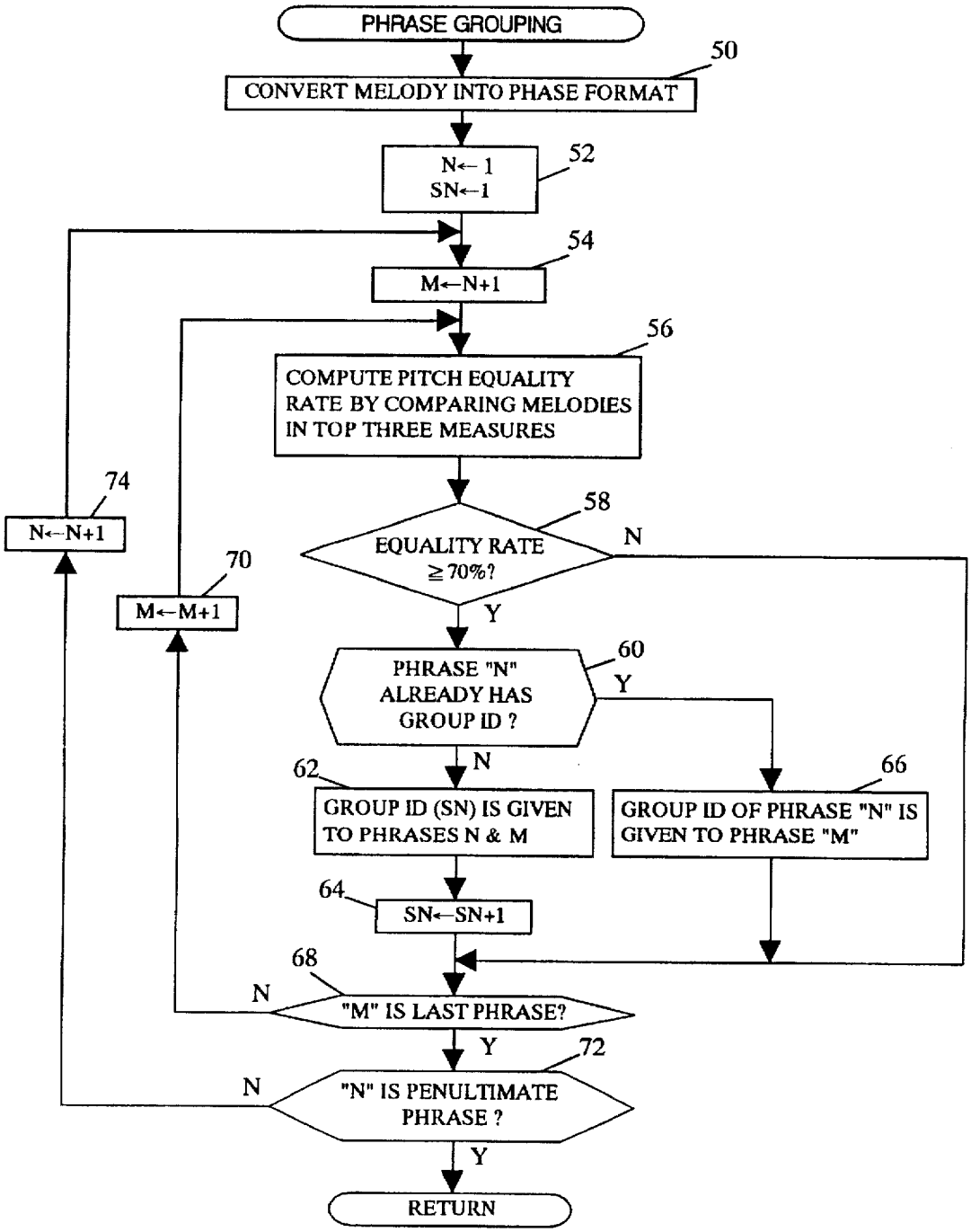
FIG. 7 is a flow chart of a subroutine for a phrase grouping processing.

FIG. 7 shows the detail of a subroutine of the phrase grouping procedure. According to the procedure of FIG. 7, the phrases having melodies which resembles each other at a high rate of equality are detected and categorized as one group for instance labeling a same group ID number.

First process to conduct is a step 50, wherein the melody information as segmented into phrases through the procedure of FIG. 3 is converted into a phase format. The phase format is defined as a progressive alignment of the pitch information of a melody resolved into a unit length (this unit is referred to as a "phase") along the time axis.

Where the phrases shown in FIGS. 8(A) and 8(B) are to be compared with each other for the phrase grouping through the subroutine shown in FIG. 7, the phase format for each phrase is as shown each in FIGS. 9(A) and 9(B). It should be noted that $N_1$ through $N_9$ and $M_1$ through $M_{11}$ are all discrete notes respectively, where $N_9$ and $M_{11}$ are both tied notes. The unit length is herein made to be an eighth note duration as an example, but can preferably be different in accordance with the music given for analysis. Ideally the note having the shortest duration among the non-tied notes should be detected and be defined as the unit time length for the processing.

In a step 52, a value "1" is set both in a register N and SN, and next in a step 54, a value "N+1" is set in a register M. The process then go forward to a step 56.

In the step 56, with respect to the phrases #N and #M as designated by the respective registers N and M, the note pitches of the respective melodies each covering the top three measures of each phrase are compared to compute a pitch equality rate. This processing is easily conducted by using a pattern matching method on the phase format. The pattern matching method may be conducted by using a pitch comparing method I as shown in FIGS. 9(A) and 9(B), a pitch comparing method II as shown in FIGS. 12(A) through 12(E), a pitch comparing method III as shown in FIG. 14 and the like.

When the processing has come to the step 56 for the first time after the step 52, the registers N and. M exhibit values "1" and "2", respectively, and therefore the note pitches of phrases #1 and #2 are compared with each other. For example, the pitch comparing method I shown in FIGS. 9(A) and 9(B) compares the note pitches of each corresponding phase with the top of phrase 1 and the top of phrase 2 being aligned together, and a pitch equality rate is computed. In the example of FIGS. 9(A) and 9(B), all of sixteen comparisons between the corresponding note pitches indicate coincidence, and therefore the equality rate will be $^{16}/_{16}\times 100=100$.

Next in a step 58, judgment is made whether the equality rate thus computed is equal to or greater than 70%. Under the present embodiment the melody equality rate is judged by the condition that the pitch equality rate for the top three measures is 70% or more, other conditions may of course be used for the judgment. When the judgment result is affirmative (Y), the process moves to a step 60.

The step 60 judges whether phrase N has already been labeled with a group ID number. When the process has come to the step 60 for the first time after the step 52, no group ID number has been given to the phrase N and the judgment of the step 60 is negative (N). Then the process goes to a step 62.

The step 62 gives the group ID number in the register SN to the phrases N and M. When the process has come to the step 62 for the first time after the step 52, the value of SN is "1", and consequently the group ID number of "1" is given to both the phrases 1 and 2. Then the program flow moves to a step 64 to increase the SN value by "1", whereby the above-mentioned SN value "1" is now changed to "2". After the step 66, the step 68 will be conducted.

In case the judgment of the step 60 is affirmative (Y), this means that the phrase N has already been labeled with its group ID number, and the process moves to a step 66 to give the same group ID number as the phrase N is given to the phrase M. For example, where the group ID number of the phrase N is "1" and M=3, then the group ID number "1" is given to the phrase 3. After the step 66, the step 68 will be conducted.

In case the judgment of the step 58 is negative (N), this means that the pitch equality rate is less than 70%, and the process skips to the step 68.

The step 68 judges whether the phrase M is the last phrase to be compared. When the process has come to the step 68 for the first time after the step 52, M=2 and the judgment results in negative (N) the process flows to a step 70.

In the step 70, the value in the register M is increased by "1". As a result, when the value M has been "2", the value now becomes "3". The process then returns back to the step 56, and the subsequent processes as explained above will be repeated. In case the procedure comes back to the step 56 with N=1 and M=3, the step 56 conducts the pitch comparison between the phrases #1 and #3.

While the processing of steps 56 through 70 are repeated, the phrase M become the last phrase and the judgment of the step 68 becomes affirmative (Y), and then the routine flows to a step 72. The step 72 judges whether the phrase N is the penultimate phrase. When the processing has come to the step 72 for the first time after the step 52, N=1 and the judgment result at the step 72 is negative (N) to push the processing to a step 74.

In the step 74, the value in the register N is increased by "1". As a result, when N value has been "1", the N value now becomes "2". The flow will then return to the step 54, and the subsequent processings will be repeated as explained hereinabove. When the process has come back to the step 54 with N=2, the M=3 and the next step 56 conducts the pitch comparison between the phrases #2 and #3.

While repeating the processings of the steps 56 through 74, the phrase N has become the penultimate phrase and the judgment of the step 72 becomes affirmative (Y) to let the flow return to the routine of FIG. 2. The fact that the phrase N is now the penultimate phrase means that the pitch comparison has been completed among all of the phrases to be compared.

At the steps 62 and 66, the indication of the phrase group ID numbers on the display 14 every time the group ID number is given to a phrase will facilitate the understanding of the structure of the music under analysis.

For the sake of simplicity, an explanation will be made about how the group ID number is given to six phrases with reference to Table 3 as an example.

TABLE 3

| | Phrase # | | | | | |
|---|---|---|---|---|---|---|
| | #1 | #2 | #3 | #4 | #5 | #6 |
| N = 1 | N | M | M | M | M | M |
| SN given | 1 | 1 | — | — | — | 1 |
| N = 2 | | N | M | M | M | M |
| SN given | 1 | 1 | — | — | — | 1 |
| N = 3 | | | N | M | M | M |
| SN given | 1 | 1 | 2 | 2 | — | 1 |
| N = 4 | | | | N | M | M |
| SN given | 1 | 1 | 2 | 2 | — | 1 |
| N = 5 | | | | | N | M |
| SN given | 1 | 1 | 2 | 2 | — | 1 |

In this Table 3, the numerals listed in the row of "SN given" show the phrase group ID numbers given to the respective phrases numbered at the top of the respective columns (#1 through #6), and "–" means that no group ID is given during that comparison cycle of the routine.

The explanation will be made about the comparison of the phrase #1 with the rest of the phrases referring to the row of "N=1" in Table 3 above. Starting with N=1, SN=1 and M=2, the first cycle of the step 56 processing is conducted, and if the judgment at the step 58 is affirmative (Y), the operation moves to step 60 with the judgment resulting negative (N), and thereafter the phrase group ID in the register SN, i.e. a value "1" is given to the phrases 1 and 2 in the step 62. Then in the step 64, SN becomes "2". Next via the step 70, M is increased to "3" and the comparison cycle returns to the step 56. In this example, the pitch equality rate is less than 70% between phrases #1 and #3 and the judgment on pitch equality is negative, and accordingly the operation skips to the step 68, giving no group ID number to phrase #3. Likewise via the step 70, the comparison cycles are further repeated for M=4 and M=5 with no group ID number being given to phrases #4 and #5. The pitch equality rate is above 70% in this case and the judgment turns out to be affirmative (Y) the process moves to the step 60, which shows an affirmative judgment to go to the step 66. The step 66 gives the phrase group ID number "1" to phrase #6. Thus the comparison of the phrase #1 with all other phrases #2 through #6 is over.

Next, the comparison of the phrase #2 with the phrases #3 through #6 will be performed. The explanation will be made with reference to the row of "N=2" in Table 3 above. The operation comes back to the step 54 via the step 74 with N=2. M is set to be "3" in the step 56. As the phrase #2 is not so close to the phrases #3 through #6 in this example, the judgment at the step 58 is negative for M=3 through 6, and therefore no phrase group ID number is given to the phrases #3 through #6.

When N is set to be "31" via the step 74 for the comparison of the phrase #3 with the phrases #4 through #6, the step 54 sets M=4 and the step 56 computes the pitch equality rate between the phrases #3 and #4. The judgment at the step 58 is affirmative (Y) in this example, and the process moves to the step 60, where the judgment becomes negative, and consequently the step 62 gives a new group ID number "2" to the phrases #3 and #4. Thereafter the step 64 sets SN=3. In the following cycles, the step 58 makes an judgment of negative and no group ID number is given to the phrases #5 and #6. A similar explanation will be applicable to the comparison of the phrase #4 with the phrases #5 and #6 under the condition of N=4.

When N is set to be "5" via the step 74 for the comparison of the phrase #5 with the phrase #6, the step 54 sets M=6 and the step 56 computes the pitch equality rate between the phrases #5 and #6. The judgment of the step 58 is now negative (N) and no group ID number is given to the phrase #5. Thus the phrase grouping state remains the same as when N=34. Shown on the display screen 14 are the musical stave notation of the music under analysis, the phrase segmentation into #1 through #6 and the phrase group ID numbers of those phrases. The operator of the apparatus understands very easily at a glance that the melody is segmented into six phrases, the phrases #1, #2 and #6 are a first kind of melody, the phrases #3 and #4 are a second kind of melody different from the first and the phrase #5 is a third kind different from the first and the second.

Next an explanation is made about a pitch comparing method II with reference to FIGS. 10(A) and 10(B), which shows musical stave notations of a phrase 3 and a phrase 4 to be compared with each other by the pitch comparing method II. It should be noted that the phrase 4 has a different length than the phrase 3 and also that the bar line positions and the phrase demarcations are different between the two.

FIG. 11 shows the melody information of the phrases 3 and 4 of FIGS. 10(A) and 10(B) in a phase format. Both formats (of phrase 3 and phrase 4) are aligned with respect to the bar lines shown by two vertical lines. According to FIG. 11, it will be recognized that the melody of the phrase 3 and that of the phrase 4 are staggered in the time axis by an amount of an eighth note time length and also that the phrase 4 is longer than the phrase 3 by the time length of an eighth note.

In this pitch comparing method II, with respect to one of the phrases the other of the phrases is positioned for comparison of the corresponding phase pairs. The positioning is sequentially shifted one after another by an integer times unit note length (an eighth note duration), where the integer takes values 1, 2, 3, . . . , n sequentially. The comparison is conducted at each positioning by computing the pitch equality rate, and among the computed equality rates the greatest value is determined as the melody resemblance degree between the two phrases.

In an example shown in FIGS. 12(A) through 12(E), phrases 3 and 4 are positioned by shifting by an amount up to two times the unit length (n=2), and the note pitches of the corresponding pair are compared with each other to compute the pitch equality rate in each positioning situation of FIGS. 12(A) through 12(E). In each situation, the comparing span is determined to be an area where the phase format data exist for both phrase lines 3 and 4. As the minimum length for a phrase is set as two beats (a half measure of quadruple meter) in this example, the maximum shift can be four times the unit length (n=33).

FIG. 12(A) is a situation where the phrase 4 is shifted leftward (earlier) by an amount of the unit length relative to the phrase 3 from the original situation shown in FIGS. 10(A) and 10(B). FIG. 12(B) is a situation where the phrase 4 is shifted leftward by twice the amount of the unit length relative to the phrase 3. FIG. 12(C) is a situation where the phrase 4 is shifted rightward (later) by an amount of the unit length relative to the phrase 3. FIG. 12(D) is a situation where the phrase 4 is shifted rightward by twice the amount of the unit length relative to the phrase 3. FIG. 12(E) is a situation where the phrase 4 is not shifted relative to the phrase 3. Table 4 summarizes the number of pitch matches (equality), the comparing span and the equality rate (matching rate) for the above five situations.

TABLE 4

| | Equality Number | Comparing Span | Equality Rate (%) |
|---|---|---|---|
| FIG. 12 (A) | 16 | 16 | $100 \times 16/16 = 100$ |
| FIG. 12 (B) | 7 | 16 | $100 \times 7/16 = 44$ |
| FIG. 12 (C) | 4 | 14 | $100 \times 4/14 = 29$ |
| FIG. 12 (D) | 4 | 13 | $100 \times 4/13 = 31$ |
| FIG. 12 (E) | 7 | 15 | $100 \times 7/15 = 47$ |

This Table 4 shows that the highest equality rate "100%" was obtained at the comparison situation where the phrase 4 has been shifted leftward by an amount of the unit time length relative to the phrase 3.

According to the above-mentioned pitch comparing method II, determination of melody resemblance degrees in a manner close to human sensation can be realized, even in case the phrase lengths are different, or the phrase demarcations are different relative to the bar line positioning as shown in FIGS. 10(A) and 10(B).

Next an explanation is made about a pitch comparing method III with reference to FIGS. 13(A) and 13(B), which shows musical stave notations of a phrase 5 and a phrase 6 to be compared with each other by the pitch comparing method III. It should be noted that the phrase 6 has a different arrangement of note pitches than the phrase 5. Namely, the top note in the phrase 5 is a quarter note while the corresponding duration (quarter note period) is divided into two eighth notes in the phrase 6, where the former eighth note has the same note pitch as the top note of the phrase 5 and the latter eighth note has a different note pitch than the top note of the phrase 5. This pattern will be very frequently encountered in actual music.

FIG. 14 shows the melody information of the phrases 5 and 6 of FIGS. 13(A) and 13(B) in a phase format. In FIG. 14, "ADS" means an address and "KON" means a key-on (start of note) where "1" denotes a key-on and "0" denotes no key-on there.

If the pitch equality rate between the phrases 5 and 6 shown in a phase format in FIG. 14 is computed by the pitch comparing method I as described with reference to FIG. 9, the rate is $100 \times 13/16 = 81\%$. However, a human being would feel that these phrases are similar in a higher level of resemblance. To simulate such a feeling on the resemblance between phrases, the inventor has introduced improved rules for comparison wherein the calculation of the counts of pitch matches (equality) will be performed in accordance with the following conditions.

(1) Pitches should be compared within a certain note duration.

(2) When the compared pitches are the same, count "1" should be made.

(3) When the compared pitches are not the same, the count value should be determined smaller as the distance from the same-pitched note position is greater according to a certain predetermined rate, e.g. count "0.5" should be made at the position just next to the same-pitched position, count "0.25" should be made at the further next position, and so on.

(4) When the compared pitches are the same again in the course of the calculation under the condition (3) above, the rule goes back to the condition (2) again followed by the condition (3.)

Table 5 shows an example of making counts for the ADS range of 0 and 1 in FIG. 14.

TABLE 5

| ADS | 0 | 1 |
|---|---|---|
| Phrase 5 | 64 | 64 |
| Phrase 6 | 64 | 65 |
| Count | 1 | 0.5 |

Table 6 shows an another example of making counts for the ADS range of 0 through 4 about possible phrase examples p and q (not specifically shown in the drawing).

TABLE 6

| ADS | 0 | 1 | 2 | 3 | 4 |
|---|---|---|---|---|---|
| Phrase p | 64 | 64 | 64 | 64 | 64 |
| Phrase q | 64 | 65 | 63 | 64 | 65 |
| Count | 1 | 0.5 | 0.25 | 1 | 0.5 |

In this example, the total counts through the span of ADS=0 through 4 make 3.25.

The computation of the pitch equality rate between the phrases 5 and 6 shown in a phase format in FIG. 14 according to the method as partly explained with reference to Tables 5 and 6 above results in $100 \times 14.5/16 = 91\%$, which value can be appreciated as being close to natural feeling of a human being.

FIG. 15 shows an example of a whole length of a melody (music) which is segmented into phrases through its entire span. The phrases are labeled with sequential phrase ID numbers from beginning to end. The above-mentioned pitch comparing methods I, II and III will be available in searching a phrase containing a melody which resembles a melody in, for example, the phrase #6. In such an instance, The determination can be performed similarly as explained with reference to FIG. 7 by judging that "two melodies are similar" when the computed pitch equality rate is equal to or greater than 70% upon comparison of the melody information, for example, in the top three measures. In case the comparing span is three measures long, the judging criteria of the pitch equality rate can be 90% for the first two measures and 70% for the third measure to perform a better judgment in view of human feeling.

The above-mentioned embodiment of the apparatus can be further modified within the scope of the present invention. Various practical modifications will be as follows, for example:

(1) In the pattern matching method for phrase segmentation, one of the note strings to be compared may be shifted relative to the other like in FIGS. 12(A) through 12(E) to adopt a maximal pitch equality rate.

(2) In case degradation of accuracy is tolerable to some extent, the average note duration can be that of a half length span of the whole melody, or of a four-measure span or other portional span in place of the mean value of all note lengths throughout the melody. Also, steps may be omitted among the steps 44 through 48 in FIG. 3, when a certain degradation in accuracy is permissible.

(3) A factor "b" to multiply average note durations "a" should not be limited to "2".

(4) The computation of a melody equality rate or a resemblance degree may be performed by comparing normalized pitch strings relative to a certain note (e.g. the top note) in the comparing span in place of absolute pitches. This method will be convenient for handling transposition of the melody.

(5) In grouping the phrases containing highly similar melody fragments, grouping symbols like A, B, C and D may be given, or color coding may be used.

A further embodiment of the apparatus according to this invention will be described hereinbelow. This embodiment is to analyze musical information to segment a melody into musical phrases, to detect the scale prevailing in a phrase, to detect the musical key of a phrase and to display the analyzed results.

For this purpose, the program memory 18 shown in FIG. 1 includes further programs for a processing of scale detection and of key detection, and the CPU executes those processings as well. These processings are to be described with reference to FIGS. 16 through 21. The working memory 20 includes further registers such as a phrase number register J, phase number registers K and L, key code registers KKC and LKC, note name registers KU and LN, and major/minor degree registers X, SUM and S. These registers are used in the processing of key detection according to a flow shown in FIGS. 20 and 21. The melody memory 22 further stores musical information relating to key detection.

Figure 16:
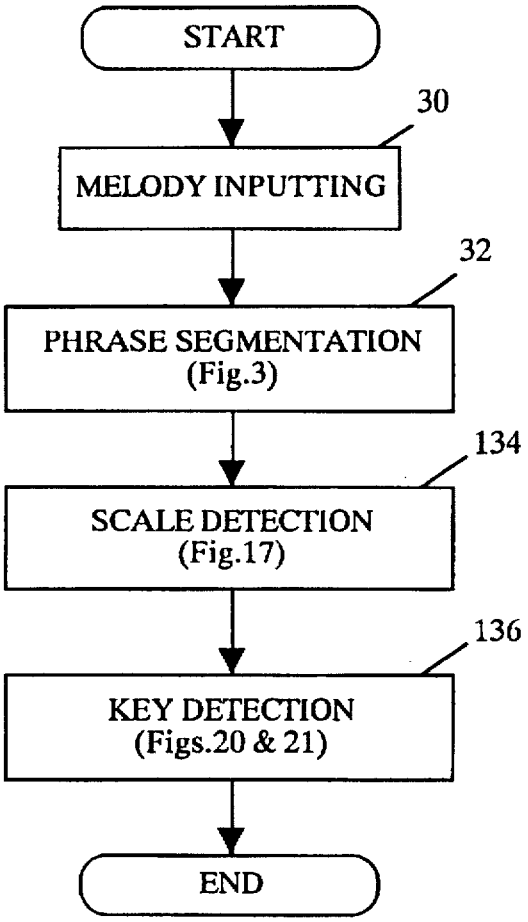
FIG. 16 is a flow chart of a main routine of another embodiment of the apparatus.

FIG. 16 shows a processing flow of a main routine in this embodiment of the apparatus according to the present invention. A step 30 processes, as described herein before with reference to FIG. 2, a melody inputting operation wherein the musical information including the melody information of a given music is inputted and is written in the memory 22. The display 14 in turn displays the melody information stored in the memory 22 for example in the form as shown hereinbefore in FIG. 4(A). A step 32 is to conduct a process of phrase segmentation. This process has been described in detail hereinbefore with reference to FIG. 3. Then the routine proceeds to a step 134.

In the step 134, a processing for scale detection is performed. This process will be described in detail later, referring to FIG. 17. As a result of the scale detecting process, there will be obtained scale information representing a scale (e.g. a scale of G) prevailing in the inputted melody information. Then the routine proceeds to a step 136. In the step 136, a processing for key detection is performed. This process will be described in detail later, referring to FIGS. 20 and 21. As a result of the key detecting process, there will be obtained key information representing a key (e.g. G major or E minor when a scale of G has been detected) prevailing in the inputted melody information.

Figure 17:
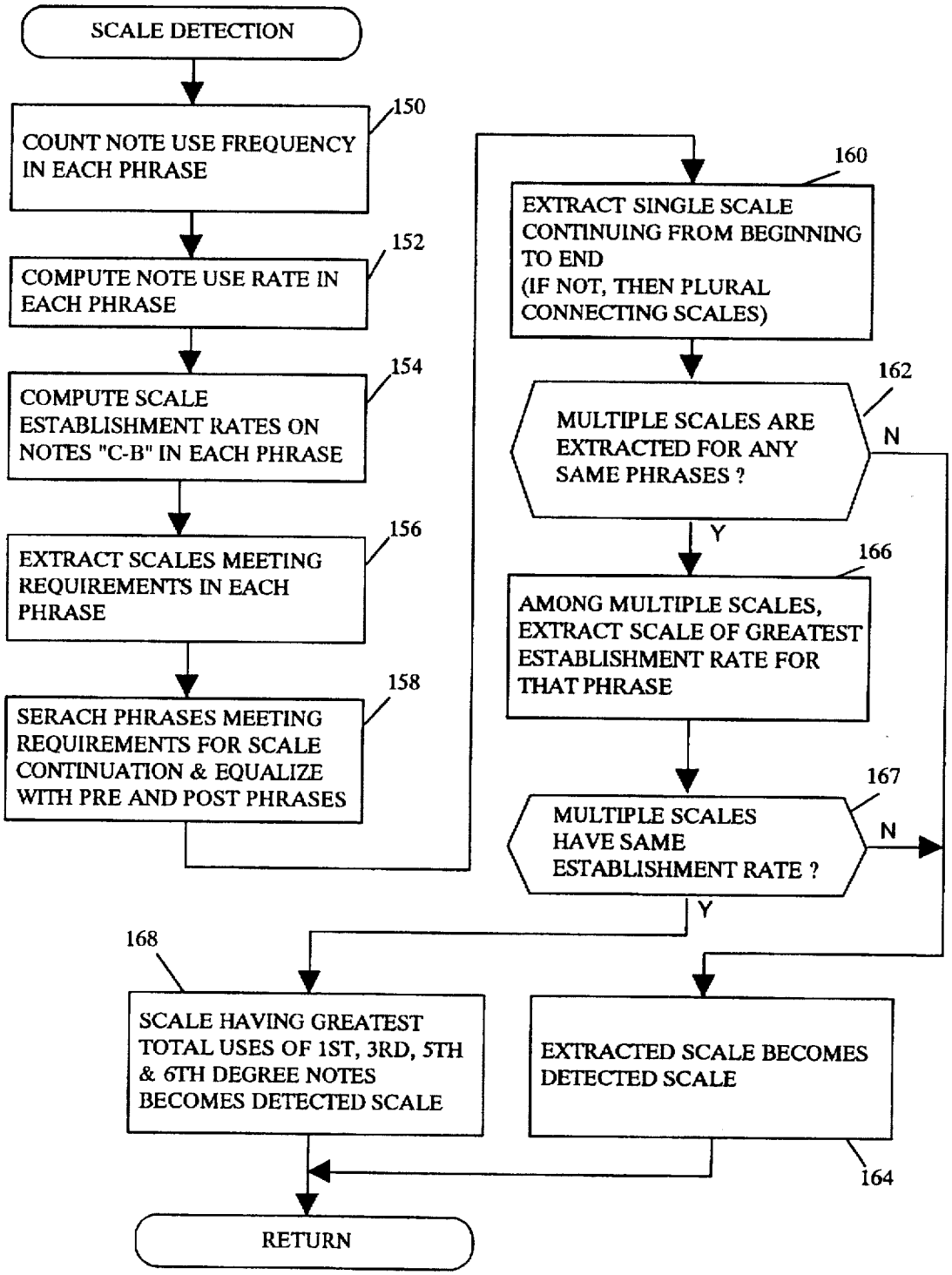
FIG. 17 is a flow chart of a subroutine for a scale detection processing.

FIG. 17 shows a subroutine of the scale detection processing. A step 150 counts the use frequency (oftenness) of the notes used in each phrase. The counting of the note use frequency is performed by first dividing each of discrete notes, multiplet notes, and else into unit note durations (lengths), for example into thirty-second notes, and then counts every note based on this unit length to obtain a point value, one point representing a thirty-second note length. Further, within a same phrase the point values of same named notes (irrespective of octave difference), such as C3 and C4, are summed up. For example in case of the phrase shown in FIG. 18(A), there is only one C note of an eighth note duration, therefore the use frequency of C note is 4 in terms of point value, i.e. 4 points.

Figure 18A:
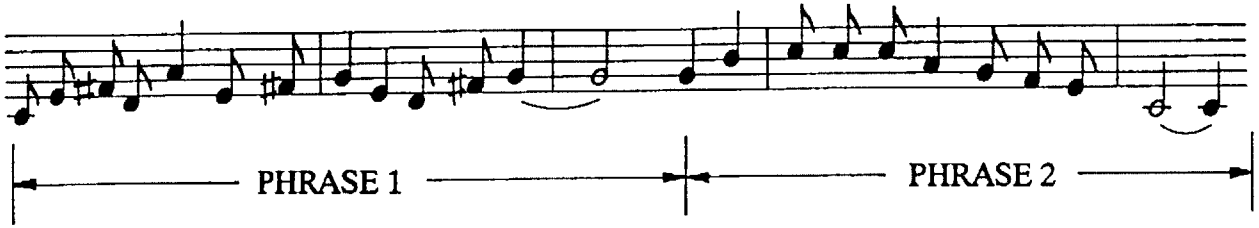
FIGS. 18(A) and 18(B) are musical stave notations illustrating phrases to be used in scale detection processing and key detection processing.

Table 7 shows the result of counting the note use frequency of each of the twelve notes C through B in the phrases 1 and 2 of FIG. 18(A).

TABLE 7

| Phrase | Note Name | | | | | | | | | | | | Phrase |
|---|---|---|---|---|---|---|---|---|---|---|---|---|---|
| Number | C | C# | D | D# | E | F | F# | G | G# | A | A# | B | Length |
| #1 | 4 | 0 | 8 | 0 | 16 | 0 | 12 | 32 | 0 | 8 | 0 | 0 | 80 |
| #2 | 36 | 0 | 0 | 0 | 4 | 4 | 0 | 12 | 0 | 8 | 0 | 8 | 72 |

Next a step 152 computes a note use rate in each phrase. The note use rate n is defined as $n=m/k\times100\%$, where m is the note use frequency and k is the phrase length both in terms of points. Table 7 indicates the phrase length of each phrase in point values. The note use frequencies in Table 7 are converted into note use rates as shown in Table 8 below.

TABLE 8

| Phrase | Note Name | | | | | | | | | | | |
|---|---|---|---|---|---|---|---|---|---|---|---|---|
| Number | C | C# | D | D# | E | F | F# | G | G# | A | A# | B |
| #1 | 5 | 0 | 10 | 0 | 20 | 0 | 15 | 40 | 0 | 10 | 0 | 0 |
| #2 | 50 | 0 | 0 | 0 | 5.6 | 5.6 | 0 | 16.7 | 0 | 11.1 | 0 | 11.1 |

It will be noticed that the total of the note use rates in each phrase is 100% if neglecting fractional errors.

Next in a step 154, an establishment rate of a scale is computed on each note of C through B in each of the phrases. The computation of the scale establishment rate is performed by summing up, for each scale, the use rate of the notes which constitute the scale. For instance, in case of the C scale, the use rate of seven notes C, D, E, F, G, A and B out of twelve notes are to be summed up.

The following Table 9 shows the computation result of the scale establishment rate with respect to the example shown in Table 8 above.

TABLE 9

| Phrase | Note Name | | | | | |
|---|---|---|---|---|---|---|
| Number | C | C# | D | D# | E | F |
| # 1 | 85 | 10 | 90 | 55 | 85 | 85 |
| 100.1 | 55.6 | 44.5 | 72.3 | 27.8 | 89 | |
| Phrase | Note Name | | | | | |
| Number | F# | G | G# | A | A# | B |
| # 1 | 15 | 100 | 45 | 55 | 65 | 35 |
| # 2 | 16.7 | 94.5 | 72.3 | 27.8 | 83.4 | 16.7 |

A scale establishment rate will be of a greater percentage as the scale constituting notes (seven notes among twelve) have higher use rates. In the above example of Table 9, phrase 1 is determined to be of a G scale and phrase 2 of a C scale.

In computing a scale establishment rate of a melody, it is important how to segment the melody into phrases. While the manner of setting phrase borders (partitions) at the positions of the bar lines of the melody, it still has some drawbacks. For instance with the example of FIG. 8(A), if the phrase 2 were set to start at the bar lines and two notes (G and B) were included in the phrase 1, the situation would be change. If such a portion falls on the modulation or the transposition in the music, important crew notes might be lost for judgment. In this FIG. 8(A) example, without the top two notes it would be difficult to decide whether the scale is C or F, as the B note cannot be taken into account.

Table 10 below shows the result of computation of scale establishment rate of C scale through B scale in each phrase in a given melody divided into twenty phrases as an example.

TABLE 10

| | Scale | | | | | | | | | | | |
|---|---|---|---|---|---|---|---|---|---|---|---|---|
| Phrase | C | C# | D | D# | E | F | F# | G | G# | A | A# | B |
| 1 | 85 | 0 | 70 | 55 | 35 | 85 | 15 | 100 | 45 | 55 | 65 | 35 |
| 2 | 100 | 25 | 83 | 43 | 55 | 65 | 35 | 100 | 55 | 60 | 100 | 45 |
| 3 | 75 | 0 | 49 | 5 | 25 | 85 | 27 | 95 | 41 | 73 | 100 | 17 |
| 4 | 71 | 0 | 80 | 0 | 0 | 100 | 30 | 100 | 53 | 43 | 100 | 23 |
| 5 | 63 | 20 | 100 | 16 | 24 | 85 | 58 | 100 | 63 | 65 | 65 | 15 |
| 6 | 96 | 13 | 90 | 0 | 30 | 85 | 17 | 94 | 49 | 51 | 65 | 31 |
| 7 | 100 | 0 | 97 | 39 | 24 | 85 | 80 | 90 | 41 | 100 | 65 | 11 |
| 8 | 67 | 0 | 63 | 41 | 0 | 100 | 9 | 100 | 49 | 59 | 65 | 32 |
| 9 | 79 | 18 | 76 | 49 | 8 | 100 | 20 | 100 | 80 | 52 | 65 | 39 |
| 10 | 80 | 12 | 82 | 0 | 5 | 85 | 12 | 100 | 91 | 59 | 65 | 22 |
| 11 | 86 | 21 | 68 | 55 | 28 | 89 | 11 | 100 | 45 | 65 | 65 | 25 |
| 12 | 93 | 0 | 100 | 35 | 25 | 91 | 30 | 37 | 76 | 49 | 100 | 45 |
| 13 | 75 | 0 | 79 | 23 | 55 | 75 | 62 | 50 | 70 | 69 | 96 | 34 |
| 14 | 86 | 0 | 81 | 19 | 32 | 83 | 43 | 68 | 69 | 65 | 100 | 30 |
| 15 | 84 | 0 | 90 | 16 | 0 | 71 | 79 | 20 | 80 | 58 | 100 | 50 |
| 16 | 95 | 13 | 79 | 27 | 23 | 80 | 75 | 95 | 40 | 76 | 90 | 29 |
| 17 | 100 | 18 | 93 | 54 | 0 | 100 | 10 | 100 | 35 | 63 | 100 | 25 |
| 18 | 90 | 0 | 90 | 0 | 0 | 70 | 25 | 90 | 37 | 64 | 65 | 23 |
| 19 | 100 | 0 | 32 | 0 | 10 | 100 | 9 | 100 | 0 | 39 | 65 | 37 |
| 20 | 100 | 0 | 48 | 12 | 15 | 75 | 2 | 100 | 16 | 54 | 65 | 32 |

A step 156 extracts a scale which meets predetermined requirements (rules) for scale extraction from each phrase. For instance, the scale extraction rules may be that a scale having an establishment rate of 100% is to be extracted with a first priority, and if there is no phrase of 100% scale establishment rate, then a phrase with 90% or more scale establishment rate is to be extracted.

Table 11 shows the result of scale extraction from Table 10 according to the above mentioned rules.

TABLE 11

| | Scale | | | | | | | | | | | |
|---|---|---|---|---|---|---|---|---|---|---|---|---|
| Phrase | C | C# | D | D# | E | F | F# | G | G# | A | A# | B |
| 1 | — | — | — | — | — | — | — | 100 | — | — | — | — |
| 2 | 100 | — | — | — | — | — | — | 100 | — | — | 100 | — |
| 3 | — | — | — | — | — | — | — | — | — | — | 100 | — |
| 4 | — | — | — | — | — | 100 | — | 100 | — | — | 100 | — |
| 5 | — | — | 100 | — | — | — | — | 100 | — | — | 100 | — |
| 6 | 96 | — | 90 | — | — | — | — | 94 | — | — | — | — |
| 7 | 100 | — | — | — | — | — | — | — | — | 100 | — | — |
| 8 | — | — | — | — | — | 100 | — | 100 | — | — | — | — |
| 9 | — | — | — | — | — | 100 | — | 100 | — | — | — | — |
| 10 | — | — | — | — | — | — | — | 100 | — | — | — | — |
| 11 | — | — | — | — | — | — | — | 100 | — | — | — | — |
| 12 | — | — | 100 | — | — | — | — | — | — | — | 100 | — |
| 13 | — | — | — | — | — | — | — | — | — | — | 96 | — |
| 14 | — | — | — | — | — | — | — | — | — | — | 100 | — |
| 15 | — | — | — | — | — | — | — | — | — | — | 100 | — |
| 16 | 95 | — | — | — | — | — | — | 95 | — | — | 90 | — |
| 17 | 100 | — | — | — | — | 100 | — | 100 | — | — | 100 | — |
| 18 | 90 | — | 90 | — | — | — | — | 90 | — | — | — | — |
| 19 | 100 | — | — | — | — | 100 | — | 100 | — | — | — | — |
| 20 | 100 | — | — | — | — | — | — | 100 | — | — | — | — |

In the case of a melody having no modulation (key change) nor implying another key, there is no such note that does not belong to a certain single scale. In such a case, a table like above Table 11 will exhibit "100%" in only one column of a certain scale throughout the melody from the first phrase to the last phrase. But in the case of Table 11, one scale has not been extracted through all the phrases. This means that there may be a possibility of modulation or transposition in the melody.

If a human being reads Table 11, he or she will look through the whole table in a batch processing fashion and understands that G scale is prevailing in the first half area, and also the possibility of A# scale may be recognized in the middle way, and the possibility of C scale or G scale may be recognized near the end of the melody.

On the other hand, there may be a method of deciding a scale from the alignment of scale possibility points in a real time processing fashion (instantaneously in the progressing time axis). According to such a method, G scale would very probably be selected up to phrase 2 and A# scale would very probably be selected at phrase 3. But in a non-real-time processing fashion, a possibility of returning to G scale at phrase 4 may also be recognized and the temporary change to A# scale may be neglected to eliminate unnecessary fluctuation. Therefore, the real-time fashioned determining method in which the scales are determined instantaneously from the top one after another in succession may sometimes be different from the non-real-time fashion by a human being.

In Table 11, if the phrase #3 is short, a human being can imagine that the key becomes temporarily indefinite at phrase 3 and returns to G again at phrase 4. In grasping the progression of scales, even if a different key appears momentarily at a short span in the melody, such sensation as modulation or transposition will fade away at a moment of return to the original key. But if a different key appears in a long span in the melody continuingly, sensation of modulation or transposition will be strongly recognized.

To cope with such a nature, a step 158 performs a scale continuation processing to eliminate a momentary interruption of a scale in the melody. In case there is such a phrase (or may be plural) which is sandwiched between the two phrases of a same extracted scale and has no extracted scale of its own, a search will be conducted among such sandwiched phrases for one or more phrases that meet the predetermined requirements (rule) for scale continuation to give the phrases thus found the same scale as the preceding and the succeeding phrase. The scale continuation rule may be that a phrase which is equal to or shorter than 4 measures of which a scale has not been extracted should be continued with the preceding and the succeeding phrases. Table 12 shows the result of the scale continuation processing applied to Table 11, and the continued phrases are given a "1" flag.

TABLE 12

| | Scale | | | | | | | | | | | |
|---|---|---|---|---|---|---|---|---|---|---|---|---|
| Phrase | C | C# | D | D# | E | F | F# | G | G# | A | A# | B |
| 1 | — | — | — | — | — | — | — | 100 | — | — | — | — |
| 2 | 100 | — | — | — | — | — | — | 100 | — | — | 100 | — |
| 3 | — | — | — | — | — | — | — | −1 | — | — | 100 | — |
| 4 | — | — | — | — | — | 100 | — | 100 | — | — | 100 | — |
| 5 | — | — | 100 | — | — | — | — | 100 | — | — | 100 | — |
| 6 | 96 | — | 90 | — | — | — | — | 94 | — | — | — | — |
| 7 | 100 | — | — | — | — | — | — | −1 | — | 100 | — | — |
| 8 | — | — | — | — | — | 100 | — | 100 | — | — | — | — |
| 9 | — | — | — | — | — | 100 | — | 100 | — | — | — | — |
| 10 | — | — | — | — | — | — | — | 100 | — | — | — | — |

TABLE 12-continued

| | Scale | | | | | | | | | | | |
|---|---|---|---|---|---|---|---|---|---|---|---|---|
| Phrase | C | C# | D | D# | E | F | F# | G | G# | A | A# | B |
| 11 | — | — | — | — | — | — | — | 100 | — | — | — | — |
| 12 | — | — | 100 | — | — | — | — | — | — | — | 100 | — |
| 13 | — | — | — | — | — | — | — | — | — | — | 96 | — |
| 14 | — | — | — | — | — | — | — | — | — | — | 100 | — |
| 15 | — | — | — | — | — | — | — | — | — | — | 100 | — |
| 16 | 95 | — | — | — | — | — | — | 95 | — | — | 90 | — |
| 17 | 100 | — | — | — | — | 100 | — | 100 | — | — | 100 | — |
| 18 | 90 | — | 90 | — | — | — | — | 90 | — | — | — | — |
| 19 | 100 | — | — | — | — | 100 | — | 100 | — | — | — | — |
| 20 | 100 | — | — | — | — | — | — | 100 | — | — | — | — |

Table 12 shows that the phrases 3 and 7 are each determined to be a continuing span, and thus the phrases 1 through 11 makes a long strings of G scale area in the melody.

Next in a step 160, a single scale that is continued from beginning to end of the a melody is searched for and is extracted. If there is no such single scale, then plural scales that connect from beginning to end of the melody is extracted (others are deleted). In the case of FIG. 18, there is no single scale that is continued from beginning to end of the melody. Therefore, a plurality of scales connecting from beginning to end of the melody are extracted, to result in Table 13.

TABLE 13

| | Scale | | | | | | | | | | | |
|---|---|---|---|---|---|---|---|---|---|---|---|---|
| Phrase | C | C# | D | D# | E | F | F# | G | G# | A | A# | B |
| 1 | — | — | — | — | — | — | — | 100 | — | — | — | — |
| 2 | — | — | — | — | — | — | — | 100 | — | — | — | — |
| 3 | — | — | — | — | — | — | — | −1 | — | — | — | — |
| 4 | — | — | — | — | — | — | — | 100 | — | — | — | — |
| 5 | — | — | — | — | — | — | — | 100 | — | — | — | — |
| 6 | — | — | — | — | — | — | — | 94 | — | — | — | — |
| 7 | — | — | — | — | — | — | — | −1 | — | — | — | — |
| 8 | — | — | — | — | — | — | — | 100 | — | — | — | — |
| 9 | — | — | — | — | — | — | — | 100 | — | — | — | — |
| 10 | — | — | — | — | — | — | — | 100 | — | — | — | — |
| 11 | — | — | — | — | — | — | — | 100 | — | — | — | — |
| 12 | — | — | — | — | — | — | — | — | — | — | 100 | — |
| 13 | — | — | — | — | — | — | — | — | — | — | 96 | — |
| 14 | — | — | — | — | — | — | — | — | — | — | 100 | — |
| 15 | — | — | — | — | — | — | — | — | — | — | 100 | — |
| 16 | 95 | — | — | — | — | — | — | 95 | — | — | 90 | — |
| 17 | 100 | — | — | — | — | — | — | 100 | — | — | 100 | — |
| 18 | 90 | — | — | — | — | — | — | 90 | — | — | — | — |
| 19 | 100 | — | — | — | — | — | — | 100 | — | — | — | — |
| 20 | 100 | — | — | — | — | — | — | 100 | — | — | — | — |

Next in a step 162, a judgment is made as to whether there is any scale from which multiple scales have been extracted. If this judgment is negative, the process moves forward to a step 164 where the extracted scale is determined as a detected scale for the extraction span by the scale detection subroutine 134. Scale information representing the determined scale is stored in the memory 20 and is also exhibited on the display 14.

When, in the step 60, a single scale continuing from beginning to end of the melody has been extracted or plural scales connecting from beginning to end of the melody have been extracted without multiplicity in any phrase, the process move from the step 162 to a stop 164 and the extracted scale or scales is or are determined for the phrases in the extraction span. After the step 164, the process returns to the main routine of FIG. 16.

When the judgment of the step 162 is affirmative (Y), the process moves to a step 166. The step 166 extracts from among the multiple scales for each phrase (as judged in the step 162) a scale which has a greatest scale establishment rate (in case there are plural such phrases being contiguous from one to another, a total of the scale establishment rates) and determines to be a detected scale for this phrase or span of contiguous phrases. In Table 13, phrases 16 and 17 (contiguous here) have multiplicity of scales, and the sum of scale establishment rates is 190 for A#, 195 for C and 195 for G, and therefore C scale and G scale are detected for the phrases 16 and 17.

Next in a step 167, a judgment is made as to whether there are multiplicity of scales extracted for the same phrase and sum of the scale establishment rates of each scale is equal to each other between the multiplicity of scales. If the judgment is negative (N), the process moves to the step 164 to determine the scale for the phrase as explained above. Let us assume, for instance, that C scales have not been extracted for phrases 16 through 20 and that G scale and A# scale have been extracted for phrases 16 and 17, then phrases 1 through 11 are determined to be in a G scale, phrases 12 through 15 to be in an A# scale and phrases 16 through 20 to be in a G scale.

When the judgment of the step 167 is affirmative (Y), the process is led to a step 168. The step 168 computes the total sum of the note use rates of the first degree note (tonic), the third degree note, the fifth degree note and the sixth degree note with respect to the respective multiplicity of scales, and determines the scale amounting to the greatest sum as the scale for the multiple-scale phrase(s). Scale information representing the determined scale is stored in the memory 20 and displayed on the display 14. Then the process returns to the main routine of FIG. 16.

In Table 13, C scale and G scale are extracted for the phrases 16 through 20 in duplicate and the total sums of the respective scale establishment rates in these phrases are equally 485, and therefore the step 168 determines the scale for the phrases 16 through 20. Let us assume that the total sum of the note use rates of the first, the third, the fifth and sixth degree notes is greater in C scale than in G scale here, the scale for the phrases 16 through 20 is determined to be C scale. Consequently, the finally detected scale flow (progression) becomes as shown in Table 14 below.

TABLE 14

| | Scale | | | | | | | | | | | |
|---|---|---|---|---|---|---|---|---|---|---|---|---|
| Phrase | C | C# | D | D# | E | F | F# | G | G# | A | A# | B |
| 1 | — | — | — | — | — | — | — | 100 | — | — | — | — |
| 2 | — | — | — | — | — | — | — | 100 | — | — | — | — |
| 3 | — | — | — | — | — | — | — | −1 | — | — | — | — |
| 4 | — | — | — | — | — | — | — | 100 | — | — | — | — |
| 5 | — | — | — | — | — | — | — | 100 | — | — | — | — |
| 6 | — | — | — | — | — | — | — | 94 | — | — | — | — |
| 7 | — | — | — | — | — | — | — | −1 | — | — | — | — |
| 8 | — | — | — | — | — | — | — | 100 | — | — | — | — |
| 9 | — | — | — | — | — | — | — | 100 | — | — | — | — |
| 10 | — | — | — | — | — | — | — | 100 | — | — | — | — |
| 11 | — | — | — | — | — | — | — | 100 | — | — | — | — |
| 12 | — | — | — | — | — | — | — | — | — | — | 100 | — |
| 13 | — | — | — | — | — | — | — | — | — | — | 96 | — |
| 14 | — | — | — | — | — | — | — | — | — | — | 100 | — |
| 15 | — | — | — | — | — | — | — | — | — | — | 100 | — |
| 16 | 95 | — | — | — | — | — | — | — | — | — | — | — |
| 17 | 100 | — | — | — | — | — | — | — | — | — | — | — |
| 18 | 90 | — | — | — | — | — | — | — | — | — | — | — |
| 19 | 100 | — | — | — | — | — | — | — | — | — | — | — |
| 20 | 100 | — | — | — | — | — | — | — | — | — | — | — |

According to Table 14, the determined scales are: G scale for phrases 1 through 11, A# scale for phrases 12 through 15 and C scale for phrases 16 through 20.

The scale detection has been thus over as shown in Table 14, but the key cannot necessarily be uniquely decided, particularly in case of natural musical scales. To be specific, although the phrase 1 through 11 have been determined to be in G scale, it has not been-decided yet whether the key is G major mode or E minor mode. Therefore, a key detection processing take place based on the result of the scale detection.

Figure 18B:
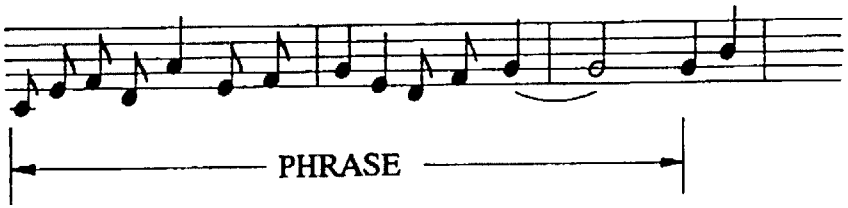

FIG. 18(B) shows a phrase to be processed through the key detection processing. When a melody proceeds according to this phrase, the human ear will recognize the major/minor feeling of the phrase as a whole based on each major/minor feeling at each moment of note sounding. The major/minor feeling at an instance of a note sounding is not simply determined by the just preceding note alone but is influenced by further preceding notes to some extent.

To facilitate the procedure, the phrase of FIG. 8(B) is divided into phases of a unit time length so that note pitches are handled on the basis of the phase. In this example, the unit length is herein taken as an eighth note duration, as the shortest note in this phrase is an eighth note, it would be best to set as same as the dividing unit (such as a thirty-second note) used in the aforementioned counting of the note use frequency.

FIG. 9(A) is a representation of the phrase of FIG. 8(B) in a phase format of an eighth note unit with the pitches of the respective phases being expressed by key code values. FIG. 9(B) is an illustration of how the major/minor degree is computed with specific respect to the phase (time point) Fi as indicated by an arrow symbol. First, in order to obtain by computation a useful major/minor degree at a moment of note sounding, the relationship between the pitch change from an earlier note to the note in question and the major/minor feeling should be clarified. In this connection, Table 15 has been provided to show the relation between the pitch changes from an earlier note and the major/minor feelings by means of major/minor points of 0,+1 and −1. This Table 15 is for a C major scale. For other scales, computation should be performed on the C major scale utilizing a necessary shift accorrding to the scale information or the data in Table 15 should be changed to meet the respective other scales according to the ordinary musical knowledge in the art.

TABLE 15

| | Note(H) | | | | | | |
|---|---|---|---|---|---|---|---|
| Note(L) | C | D | E | F | G | A | B |
| C | 0 | 0 | 0 | +1 | +1 | +1 | 0 |
| D | 0 | 0 | 0 | −1 | +1 | −1 | +1 |
| E | 0 | 0 | 0 | 0 | +1 | −1 | −1 |
| F | +1 | −1 | 0 | 0 | 0 | +1 | 0 |
| G | +1 | +1 | −1 | 0 | 0 | 0 | +1 |
| A | −1 | −1 | −1 | −1 | 0 | 0 | 0 |
| B | 0 | +1 | −1 | 0 | −1 | 0 | 0 |

In the table, "0" means the note progression gives no particular major/minor feeling,"+1" means the note progression gives a major feeling and "−1" means the note progression gives a minor feeling. This table is stored in the program memory 18 shown in FIG. 1.

In the procedure of determining major/minor points, two notes for comparison are applied to Table 15 as follows according to the pitches of the two notes irrespective of their occurrence order. The higher note of the two is appointed in the top index line "Note (H)" while the lower of the two is appointed in the leftmost index column "Note (L)". For example, in the case of comparing note E and note G, if those notes are E3 and G3 (G3 is higher than E3 in pitch), the intersection of G column and E row gives "+1", and if those notes are E4 and G3 (E4 is higher than G3), the intersection of E column and G row gives "−1".

In order to compute the major/minor degree of the note at a phase in question, not only the just preceding phase but also a plurality of earlier phases should preferably be taken into account. Therefore, in the example of FIG. 19(B), the notes at eight phases preceding the Fi phase are now taken into computation. The Fi note is compared with each of the eight preceding notes, and the respective points on the major/minor feeling are obtained according to Table 15.

Figure 19A:
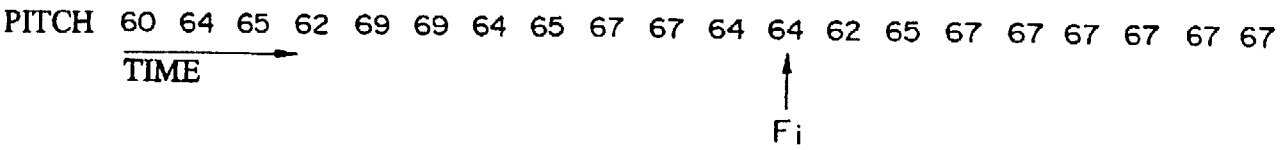
FIGS. 19(A) and 19(B) are phase formats showing how the computation of a major/minor degree goes.
Figure 19B:
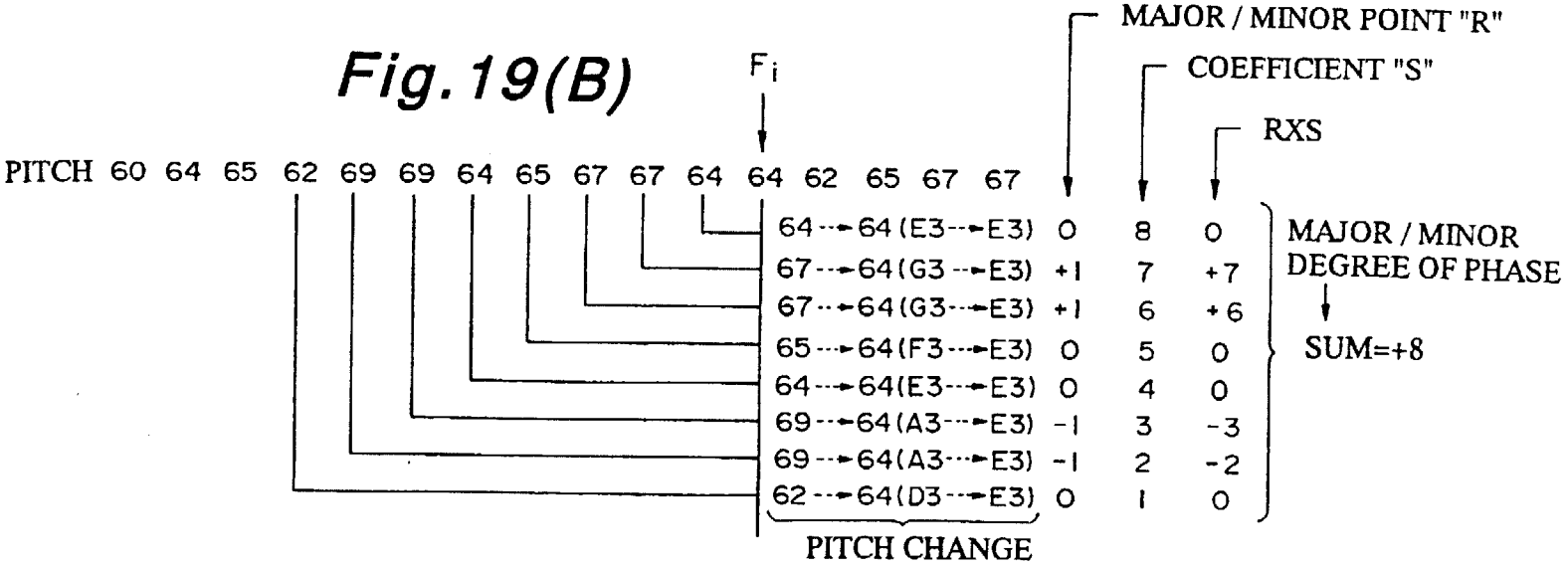

Among the eight notes preceding the Fi phase note, the nearer the phase is, the greater influence the note will give to the major/minor feeling. In this connection, coefficients S have been determined to have a greater value as the phase is nearer to the Fi phase, namely 8 through 1 as shown in FIG. 19(B). The respective major/minor points R are multiplied by the respective coefficients S the make the respective products R×S. The eight products thus obtained are summed up to get a major/minor degree for the note at phase Fi. In this example, the Fi note gets a total of +8 points of major/minor feeling, and is recognized to have a strong major mode feeling.

Applying the above explained manner of computing the major/minor degree of a note at a phase to the notes at all of the phases in a musical phrase, a series of major/minor degree values will be obtained for the phrase. An example may be like Table 16 below. It should be noted, however, that the degree values are just for convenience's sake to show how they look like, and that they are not actually computed based on the phase format shown in FIG. 19(B).

TABLE 16

| Pitch | 60 | 64 | 65 | 62 | 69 | 69 | 64 | 65 | 67 | 67 | 64 | 64 | 62 | 65 | 67 | 67 | 67 | 67 | 67 | 67 |
|---|---|---|---|---|---|---|---|---|---|---|---|---|---|---|---|---|---|---|---|---|
| M/m Degree | +2 | −3 | 0 | +14 | +6 | +3 | −1 | +13 | 0 | +5 | +2 | +8 | −3 | +12 | +7 | +9 | −3 | 0 | +2 | +5 |

Pitch: pitch at each phase;
M/m Degree: major/minor degree at each phase

Next, a phrase major/minor degree (i.e. a major/minor degree of a phrase as a whole) is obtained. This is computed by summing up all the phase major/minor degrees (i.e. all major/minor degrees at respective phases) in the phrase. With the example of Table 16, phrase major/minor degree is +78, which means this phrase is in a major mode scale.

Then in the manner as described, phrase major/minor degrees of all of the phrases of a music (melody) are computed. Table 17 shows an example of the results of scale detection and major/minor degree computation of a music consisting of fifteen phrase segments.

TABLE 17

| Phrase # | Scale | Phrase Major/ Minor Degree | Area Major/ Minor Degree | Key |
|---|---|---|---|---|
| 1 | C | +52 | +315 | C |
| 2 | C | +38 | | Major |
| 3 | C | +82 | | |
| 4 | C | 0 | | |
| 5 | C | +38 | | |
| 6 | C | 0 | | |
| 7 | C | +57 | | |
| 8 | C | −14 | | |
| 9 | C | −47 | | |
| 10 | C | +15 | | |
| 11 | G | −59 | −156 | E |
| 12 | G | −34 | | Minor |
| 13 | G | +12 | | |
| 14 | G | −25 | | |
| 15 | G | −50 | | |

Table 17 further includes area major/minor degrees and area major/minor degree is obtained by summing up phrase major/minor degrees through an area, and the key prevailing in the area is determined based on the scale and major/minor degree. In this table, an area from phrase #1 through phrase #10 has a detected scale "C" and a computed area major/minor degree "+315", and consequently is determined to be in the key of C major. Another area from phrase #11 through phrase #15 has a detected scale "G" and a computed area major/minor degree "−156", and consequently is determined to be in the key of E minor.

Figure 20:
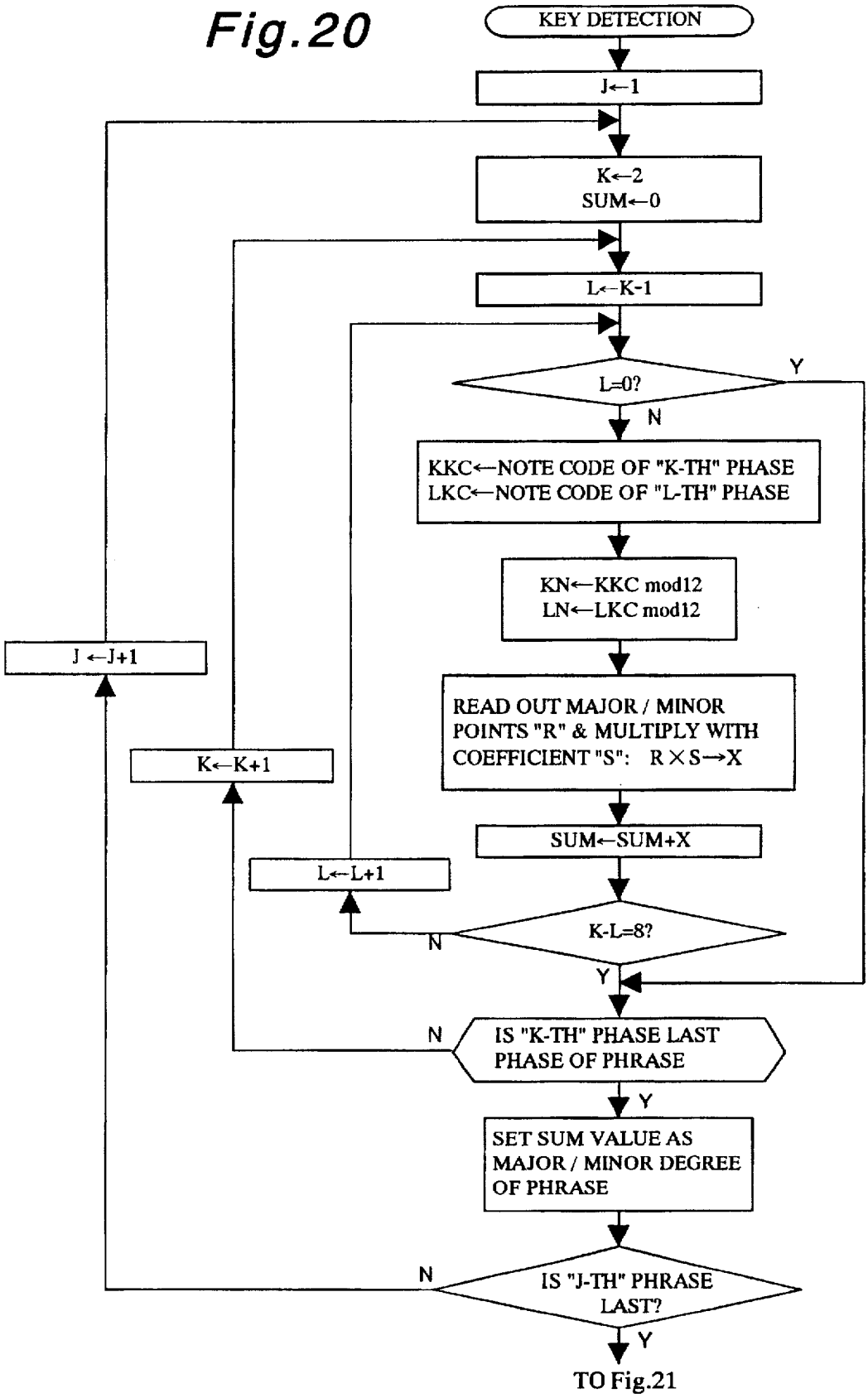
FIG. 20 is a flow chart of the earlier portion of a subroutine of key detection processing.
Figure 21:
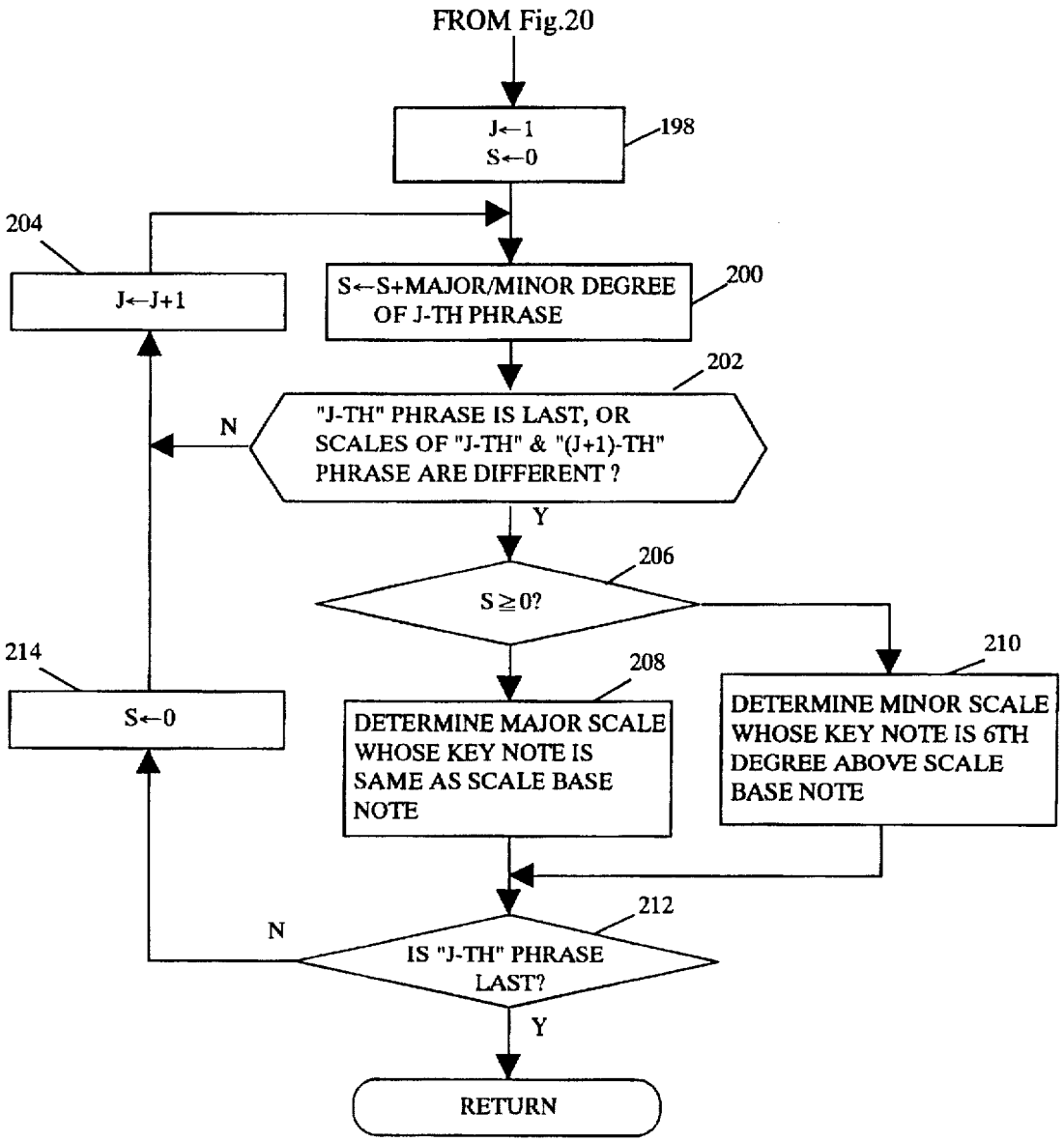
FIG. 21 is a flow chart of the later portion of a subroutine of key detection processing.

FIGS. 20 and 21 in combination show a subroutine for key detection processing capable of performing above-mentioned key detection. In a step 170, a phrase number register J is set as "1" to start the computation of major/minor degrees from phrase 1. In a step 172, a phase number register K is set to be "2", and a major/minor degree register SUM is set to be "0". Next, a step 174 sets a value of "K-1" in a register L. According to such a procedure, when the flow has come to the step 174 for the first time after K=2 is set at the step 172, L becomes 1 to be ready for the pitch comparison of phase 1 and phase 2. After the step 174, the process moves to a step 175.

The step 175 is to judge whether the value of L is equal to zero or not. If this judgment is negative (N), the flow goes to a step 176, where the note codes (key codes) of K-th and L-th phases are set in registers KKC and LKC, respectively. The K-th phase and the L-th phase are designated (appointed) by the values in the register K and the register L, respectively. When the process has come to the step 176 for the first time after the step 72 and the step 74, the note codes at the second and the first phase are set into KKC and LKC, respectively.

Next in a step 178, note name detecting processing takes place. Namely, the value in the register KKC is divided by 12 (integer level computation) and the residue is obtained (KKC mod 12). The residue represents a note name without an octave nomination and is set into a register KN. Where the note pitches C4, C#4, D, . . . E . . . are represented by note codes 60, 61, 62, . . . 64 . . . , and note names C, C#, D, . . . E . . . are represented by note codes 0, 1, 2, . . . 4 . . . , the computation of "64 mod 12" makes "4" to convert E4 note pitch into E note name. This value "4" is set into the KN register. Similarly the computation of "LKC mod 12" is performed to obtain the residue representing the note name of LKC. This note name is set into a register LN. The process move forward to a step 180.

In the step 180, a major/minor point R is read out from the major/minor points table (Table 11) in the memory 18 based on the pitch relation between the note code (key code) of the register KKC and the note code of the register LKC and on the note name information of the registers KN and LN. The memory 18 also stores the coefficient S, which is also read out corresponding to the phase distance which is defined by the difference between the register K value and the register L value. Then the major/minor point R is multiplied by the coefficient S to produce a product R×S, which is stored in a register X. This X value is the major/minor degree of the phase. For example, when R=+1 and S=7 are read out from the memory 18 as shown in FIG. 19(B), the product R×S=+7 is set in the register X.

Next in a step 182, the register X value is added to the major/minor degree register SUM value and the computation result is set in the SU M as its new value of accumulation. Then the process goes to a step 184.

The step 184 judges whether the value of K−L is equal to 8 (whether L reaches down the phase which is 8 phases earlier than K). When the routine has come to the step 184 for the first time after the steps 72 and 74, the register values are K=2 and L=1, and the judgment at the step 184 is negative (N) to direct the routine to a step 186.

In the register 186, the register L value is decreased by 1 and the routine goes back to the step 175, which judges whether L=0 or not. When the process has come to the step 186 for the first time after the steps 172 and 174, L=0, and the judgment of the step 175 is affirmative (Y), and the flow is directed to a step 188.

The step 188 judges whether the K-th phase is the last phase in the phrase under analysis. When the process has come to the step 188 for the time after the steps 172 and 174, K=2 , which is not the last phase, and the judgment is negative (N), and the flow moves to a step 190.

The step 190 increases the register K value by 1 and directs the flow to the step 174, where K−1 is set into the register L. Consequently the computation of the major/ minor degree is possible about the next phase. For example, when K=3 at the step 90, L=2 at the step 174, then the pitch comparison between the phases 3 and 2 becomes possible.

Likewise, the above-explained procedure of the steps 174 through 188 is repeated until the register value K becomes 9 in the step 190. Up until now, K–L=8 has not occur, the flow moves from the step 175 to the step 188 with L=0.

However, when K=9 occurs via the step 190, the step 174 sets 8 in the register L to be ready for the pitch comparison between phrases 9 and 8. Thus the procedure of the step 175 through the step 186 is repeated until L=1 occurs in the step 186.

When L=1 occurs in the step 186, the process proceeds via the step 175 to conduct the processing of the steps 176 through 182. And thereafter the step 184 judges that K–L =9–1 =8, i.e. affirmative (Y) and leads to the step 188. In the above procedure, the major/minor degree of the phase 9 has been computed by taking the pitches of eight preceding phases into consideration as explained with reference to FIG. 19(B).

If the phase 9 is not the last phase of the phrase 1, the step 188 is followed by the step 190 to make the register K value 10. And in the step 174, the register L is set to be 9, and thereafter via the step 175 the processing of the steps 176 through 186 is repeated eight times to draw an affirmative (Y) judgment to move to the step 188. And therefore, after K=9 has occurred in the step 190, the phase major/minor degree of each phase is computed by taking the pitches of eight preceeding phases thereof into consideration as explained with reference to FIG. 19(B).

By repeating the processings of the steps 174 through 190, the K-th phase will become the last phase of the phrase 1, and the judgment of the step 188 becomes affirmative (Y). The process moves to a step 192.

In the step 192, the value of the register SUM is stored in the memory 20 as the phrase major/minor degree. As a consequence, when the processing has been completed up to the last phase of the phrase 1 as explained above, the major/minor degree of the phrase 1 is stored in the memory 20. The process next moves to a step 194.

The step 194 judges whether the J-th phrase is the last phrase in the given melody (music). J-th phrase is represented by the value in the register J. When the process has come to the step 194 for the first time after J=1 was set at the step 170, the judgment of the step 194 is negative (N), and the process moves to a step 196.

The step 196 increases the value of the register J by 1. Then the flow comes back to the step 172, and the processings from the step 172 will be performed in a manner explained above. Thus with J=2 via the step 196, the processings of the step 172 and so forth is conducted about the phrase 2. Likewise, the phrases 3, 4 and so on will be analyzed by the similar processings.

As the processings have been performed in this manner, when the J-th phrase comes to the last phrase of the music, the step 194 gives an affirmative judgment (Y ) to direct to a step 198 in FIG. 21. At this instance, the memory 20 stores the phrase major/minor degrees of all the phrases of the music, and such information is displayed on the display 14.

The processings by the step 198 and thereafter shown in FIG. 21 are to determine the key of the phrase under analysis based on the scale information and the phrase major/minor degree information stored in the memory 20. The step 198 sets "1" in the phrase number register J and "0" in the major/minor degree register S. Then the process moves to a step 200.

In the step 200, the value of the register S is added with the major/minor degree of the J-th phrase, and the total is set in the register S. The process moves to a step 202.

The step 202 judges whether the J-th phrase is the last phrase in the music or whether the scale of the J-th phrase and the scale of the (J+1)-th phrase are different. When the process has come to the step 202 for the first time after the step 198, J=1, which is not the last phrase. And if the phrase 1 and the phrase 2 have the same scale as shown in the aforementioned Table 17, the judgment by the step 202 results in negative (N) and the process moves to a step 204.

The step 204 increases the value of the register J by an amount of "1", and the process comes back to the step 200 to conduct the accumulation process of the major/minor degree of the register S as explained above. When J=1 has been in the register J, the result from the step 204 becomes J=2, and thereby the phrase major/minor degrees of the phrase 1 and phrase 2 are added together and the total value is stored anew in the register S.

By repeating such processings, the J-th phrase reaches the last phrase and the judgment of the step 202 becomes affirmative (Y). The process moves to a step 206. Also in the case that the phrase 10 and the phrase 11 have different scales, the process comes to the step 206.

The step 206 judges whether the register value S is equal to or greater than "0". At this moment, the register S is set with a sum total of the phrase major/minor degrees of the phrases 1 through J, the sum total indicating an area major/minor degree. If the result of the step 206 judgment is affirmative (Y), the process moves to a step 208 and determines the key of an area consisting of 1st through J-th phrases to be a major key having a root note which is the same as the basic note of the detected scale. For example, where the detected scale is C in the phrases 1 through 10 as shown in Table 17 above and the area major/minor degree is +315, the key of the phrases 1 through 10 is determined to be "C major."

When the judgment of the step 206 is negative (N), the process proceeds to a step 210. In the step 210, the key of an area consisting of 1st through J-th phrases to be a minor key having a root note which is sixth degree above the basic note of the detected scale. For example, in the phrases 1 through 10 of a C scale as mentioned above, if the area major/minor degree is of a minus value, the key in the area of phrase 1 through 10 is determined to be "A minor."

After the steps 208 or 210, the process moves to a step 212 The step 212 judges whether the J-th phrase is the last phrase in the music. As explained before, when the step 202 judges to be the last phrase, the judgment of the step 212 is also affirmative, and the process returns to the main routine of FIG. 16.

In case the adjacent (successive) phrases are of different scales according to the judgment of the step 202, the judgment of the step 212 is negative (N), and the process moves to a step 214. The step 214 sets a value "0" in the register S. And then increasing the register value J by "1" in a step 204, the process goes back to the step 200 to repeat the above explained flow.

As an example, in the above Table 17, when the procedure by the step 208 determines the area consisting of phrases 1 through 10 is in a "C major key", the process goes via the steps 212 and 214 to the step 204 to make J=11. Thereafter, the processings by the steps 200 and 202 are repeated until the step 204 outputs J=15.

When the process comes to the step 202 after the process of the step 200 with J=15 set at the step 204, the judgment of the step 202 is affirmative (Y), and the process moves to the step 206.

In the step 206, if the register S value is "–156" as shown in Table 17, the judgment is negative (N), and the process moves to the step 210. In the step 210, the key of the area consisting of phrases 11 through 15 is determined to be "E minor," as the scale for the phrases 11 through 15 is "G."

The key information which represents the key determined by the steps 208 or 210 is stored in the memory 22 together with the melody information and is displayed on the display 14.

The above-mentioned embodiment of the apparatus can be further modified within the scope of the present invention. Various practical modifications will be as follows, for example:

(1) The predetermined values such as "90% " in the embodiment can be other numerals.

(2) The procedures in the embodiment may be suitably omitted, when a certain degradation in accuracy is permissible.

(3) While the embodiment is explained about the scale detection of the natural minor scale, the scale detection technique of this invention is applicable to the melodic minor scale and the harmonic minor scale.

(4) While the phase major/minor degree detection was explained employing the comparison of the note pitch of a phase with the pitches of eight preceding phases to compute the major/minor degree of the phase, the number of the preceding phases to be compared may be more than or less than eight.

(5) While the routine of FIG. 10 performs the pitch comparison of each phase with seven or less preceding phases until K=9 occurs, the comparison may be conducted for each phase with eight preceding phases even before K=9 occurs.

(6) The phrase segmentation process preceding the scale detection process may be conducted by a manually inputting manner. Also, the scale determination process preceding the key detection process may be conducted by a manually inputting manner.

Having thus described exemplary embodiments of the present invention, it should be noted by those skilled in the art that the within disclosures are exemplary only and that various other alternatives, adaptations and modifications may be made within the scope of the present invention. Accordingly, the present invention is not limited to the specific embodiments as illustrated herein, but is only limited by the following claims.

What is claimed is:

1. A musical information analyzing apparatus comprising:

receiving means for receiving music information representing a given music composed of musical notes and musical rests, said music information including pitch information and duration information of the notes and duration information of the rests constituting the given music;

computing means for computing an average note duration for a predetermined span of said given music based on the note duration information in said span; and phrase segmentation means for dividing said span of the given music into phrases by setting demarcating ends for each phrase based on said average note duration computed by said computing means.

2. A musical information analyzing apparatus as claimed in claim 1, wherein said predetermined span of the given music is a whole span of said music.

3. A musical information analyzing apparatus as claimed in claim 1, wherein said predetermined span of the given music is a fragmentary span of said music.

4. A musical information analyzing apparatus as claimed in claim 1, wherein said computing means computes said average note duration for said predetermined span, in case said music includes a rest next to a note within said span, by adding the duration information of said rest to the duration information of said note to provide a merged note duration information to be used as a note duration information for the computation of said average note duration.

5. A musical information analyzing apparatus as claimed in claim 1, wherein said segmentation means multiplies said average note duration by a constant to make a multiplication product, finds border notes each having a note duration which is equal to or approximately equal to said product, and sets each phrase end at a tail of each said border note duration.

6. A musical information analyzing apparatus as claimed in claim 1, wherein said computing means computes an average note duration for each of the phrases based on the note duration information within said each of the phrases whose demarcating ends have been set by said phrase segmentation means, and said phrase segmentation means judges the appropriateness of each of said demarcating ends between the phrases based on said average note duration computed for each of the phrases and cancels a demarcation end on which the judgment of the appropriateness has been proved negative.

7. A musical information analyzing apparatus as claimed in claim 1, wherein said phrase segmentation means judges whether a same melody fragment as a melody in any of the phrases is found in any other phrases thus demarcated and whether a remainder fragment other than said melody fragment of the phrases is of a longer or equal duration than a predetermined minimum phrase length, and additionally sets a demarcating end between said melody fragment and said remainder fragment to divide into separate phrases when the judgment on duration of said remainder fragment has been proved affirmative.

8. A musical information analyzing apparatus as claimed in claim 4, wherein said segmentation means multiplies said average note duration by a constant to make a multiplication product, finds border notes each having a note duration which is equal to or approximately equal to said product, and sets each phrase end at a tail of each said border note duration.

9. A musical information analyzing apparatus comprising:

computing means for computing a degree of resemblance between melodies of plural phrases of a given music which has been divided into phrases, detecting means for detecting, from among the plural phrases of said music, a phrase of which said degree of melody resemblance is above a predetermined reference resemblance level base on the degrees of resemblance computed by said computing means.

10. A musical information analyzing apparatus as claimed in claim 9, wherein said computing means computes a degree of pitch resemblance between two phrases among said plural phrases by comparing note pitches between corresponding unit time lengths in said two phrases, said comparison of the note pitches being conducted by shifting one of the phrases under comparison relative to the other of the phrases under comparison by an amount equal to an integer times said unit time length thereby obtaining a tentative degree of pitch resemblance for one shift, where said integer is same for one comparison but is different sequentially from one comparison to another between 0 and n, n being a predetermined integer thereby obtaining n tentative degrees of pitch resemblance for n shifts, and said computing means outputs the largest among said obtained tentative degrees of pitch resemblance as a determined degree of pitch resemblance between said phrases under comparison.

11. A musical information analyzing apparatus as claimed in claim 9, wherein said computing means computes a degree of pitch resemblance between two phrases among said plural phrases by comparing note pitches between corresponding unit time length span in said two phrases, said comparison of the note pitches being conducted by adding up, per each corresponding pair of unit time length span between the phrases under comparison, a point determined by a predetermined rule for resemblance, said rule being that a point to be added where the pitches are equal is a predetermined value and that a point to be added where the pitches are not equal is a fractional factor times said predetermined value, said fractional factor being smaller as the unit time length span under comparison becomes farther from the unit time length span where the pitches have been equal, said computing means outputs the added up points as a determined degree of pitch resemblance between said phrases under comparison.

12. A musical information analyzing apparatus comprising:

computing means for computing a scale establishment rate of each of plural phrases of a given music which has been divided into phrases, the computation being done based on pitch information of the music;

scale extracting means for extracting from and for said each phrase a musical scale which meet predetermined requirements for extracting a scale based on said scale establishment rate computed by said computing means; and scale continuing means for continuing a scale for plural phrases by searching a phrase through such phrases as have no extracted scale therefrom by said scale extracting means but are sandwiched between the phrases which have a same extracted scale in common, and then by assigning said same extracted scale to the searched scale.

13. A musical information analyzing apparatus comprising:

receiving means for receiving music information representing a given music and being divided into plural phrases;

computing means for computing a scale establishment rate of each of said plural phrases based on said pitch information of the notes;

first scale extracting means for extracting from and for said each phrase a musical scale which meet predetermined requirements for extracting a scale based on said scale establishment rate computed by said computing means;

second scale extracting means for extracting from among the musical scales extracted by said first scale extracting means plural scales which contiguously encompass from beginning to end of said given music;

judging means for judging whether there is any phrase from which multiple scales have been extracted by said second extracting means; and scale selecting means for selecting, in case the result of the judgment by said judging means is affirmative, a scale which meets a predetermined requirements for selecting a scale to be determined as a scale for said phrase under judgment.

14. A musical information analyzing apparatus as claimed in claim 13, further comprising:

phrase segmentation means for dividing a whole or a partial span of a given music into phrases based on an average note duration within said span.

15. A musical information analyzing apparatus as claimed in claim 13, further comprising:

phrase segmentation means for dividing a whole or a partial span of a given music into phrases based on an average note duration within said span.

16. A musical information analyzing apparatus comprising:

receiving means for receiving music information representing a span of music including plural phrases which have a detected scale thereof in common;

computing means for computing a major/minor degree of said scale by comparing timewisely adjacent note pitches in each of said plural phrases;

determining means for determining a key of said span of music based on the major/minor degree computed by said computing means and on said detected scale.

17. A musical information analyzing apparatus as claimed in claim 16, wherein said computing means computes said major/minor degree by comparing a pitch of an object note with pitches of preceding plural notes individually thereby obtaining individual major/minor points respectively and adding up said major/minor points with each point being weighted by a weighting factor which is so predetermined as to be greater as the distance between said object note and the preceding individual note with which the object note is compared is greater, the added-up points becoming a major/minor point of said object note, and in turn adding up major/minor points of the object notes in a musical phrase to obtain a major/minor point of said musical phrase.

* * * * *